US009639034B2

(12) United States Patent
Matsumoto et al.

(10) Patent No.: US 9,639,034 B2
(45) Date of Patent: May 2, 2017

(54) IMAGE FORMING APPARATUS AND REMOVING MEMBER

(71) Applicant: FUji Xerox Co., Ltd., Minato-ku, Tokyo (JP)

(72) Inventors: Yasutaka Matsumoto, Kanagawa (JP); Satoshi Shigezaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/070,727

(22) Filed: Nov. 4, 2013

(65) Prior Publication Data

US 2014/0270839 A1 Sep. 18, 2014

(30) Foreign Application Priority Data

Mar. 18, 2013 (JP) ..... 2013-054713

(51) Int. Cl.
*G03G 15/16* (2006.01)

(52) U.S. Cl.
CPC ..... *G03G 15/168* (2013.01)

(58) Field of Classification Search
USPC ..... 399/101
See application file for complete search history.

(56) References Cited

U.S. PATENT DOCUMENTS 5,480,930 A * 1/1996 Gentle et al. ..... 524/414
7,471,924 B2 * 12/2008 Shigezaki ..... G03G 21/0017 399/349
7,715,778 B2 * 5/2010 Sugimoto ..... G03G 21/0017 15/256.5
7,805,103 B2 * 9/2010 Ueno ..... G03G 21/0017 399/350

(Continued)

FOREIGN PATENT DOCUMENTS

JP 2002-116642 A 4/2002
JP 2006-301564 A 11/2006

(Continued)

OTHER PUBLICATIONS

Dupont, Dupont Viton A-401C, Technical Information, Jul. 3, 2010, pp. 1-8.*

(Continued)

*Primary Examiner* — Clayton E Laballe
*Assistant Examiner* — Linda B Smith
(74) *Attorney, Agent, or Firm* — Sughrue Mion, PLLC

(57) ABSTRACT

An image forming apparatus includes a carrier that carries a toner image formed by a toner, the toner including a toner body and an external additive, a circularity of the external additive being about 0.5 to about 0.9, a transfer member that holds a transferred body between the transfer member and the carrier, the transfer member transferring the toner image to the transferred body, and a removing member that includes a contact portion, the contact portion contacting the transfer member, the removing member removing toner that adheres to the transfer member from the toner image carried by the carrier, the contact portion being made of an elastic material that satisfies an inequality (1) below:

$$A \geq -2.5 \times B + 102 \quad (1)$$

where A denotes a pure water contact angle (°) at 23° C. and 55% RH, and B denotes a 100% modulus (MPa) at 23° C.

12 Claims, 7 Drawing Sheets

(56) References Cited

U.S. PATENT DOCUMENTS

2004/0131372 A1* 7/2004 Fujita et al. ..... 399/57
2007/0020005 A1* 1/2007 Shigezaki et al. ..... 399/349
2007/0217842 A1* 9/2007 Kato ..... G03G 9/0821 399/350
2007/0242972 A1* 10/2007 Al ..... G03G 15/168 399/101
2008/0292338 A1 11/2008 Fujiwara
2008/0311505 A1* 12/2008 Akioka ..... G03G 9/125 430/114
2009/0003898 A1* 1/2009 Kayahara et al. ..... 399/327
2009/0123184 A1* 5/2009 Kobashi ..... 399/175
2009/0190950 A1 7/2009 Ai et al.
2009/0269095 A1* 10/2009 Mitsuhashi ..... G03G 15/5095 399/66
2010/0142985 A1* 6/2010 Minbe ..... G03G 15/2032 399/66
2010/0203443 A1* 8/2010 Okita ..... G03G 9/09708 430/124.1
2011/0058832 A1 3/2011 Suzuki et al.
2011/0229233 A1* 9/2011 Watanabe et al. ..... 399/350
2012/0045716 A1* 2/2012 Imamura ..... 430/105
2012/0163890 A1* 6/2012 Uematsu ..... G03G 21/0017 399/350
2012/0189851 A1* 7/2012 Zenitani et al. ..... 428/404
2012/0237267 A1* 9/2012 Fukao et al. ..... 399/252
2013/0017002 A1* 1/2013 Yoshikawa ..... 399/274
2013/0071163 A1* 3/2013 Watanabe et al. ..... 399/346
2013/0243484 A1* 9/2013 Toda et al. ..... 399/159
2013/0322932 A1* 12/2013 Nishida ..... 399/284
2014/0016956 A1* 1/2014 Terasaki ..... G03G 15/1675 399/66
2014/0119759 A1* 5/2014 Yamaura ..... G03G 15/168 399/66

FOREIGN PATENT DOCUMENTS

JP 2007-292841 A 11/2007
JP 2008-292567 A 12/2008
JP 2009-180866 A 8/2009
JP 2011-59437 A 3/2011
JP 2011-145584 A 7/2011
JP 2012-149190 A 8/2012

OTHER PUBLICATIONS

Munro Rubber, Viton A 66% Fluorine Rubber Sheet Product Information.*
Japanese Patent Office communication dated Nov. 22, 2016 for jp 2013-054713, the counterpart to the US application.*
Communication dated Aug. 18, 2015 from the Japanese Patent Office in counterpart application No. 2013-054713.
Communication dated Mar. 22, 2016 from the Japanese Patent Office in counterpart application No. 2013-054713.

* cited by examiner

FIG. 4

| | | | SILICA PARTICLES | | | | | | | | | |
|---|---|---|---|---|---|---|---|---|---|---|---|---|
| | | | @1 | | @2 | | @3 | | @4 | | @5 | |
| | | | CIRCULARITY 0.46 | VOLUME AVERAGE PARTICLE DIAMETER 415 nm | CIRCULARITY 0.52 | VOLUME AVERAGE PARTICLE DIAMETER 391 nm | CIRCULARITY 0.75 | VOLUME AVERAGE PARTICLE DIAMETER 150 nm | CIRCULARITY 0.89 | VOLUME AVERAGE PARTICLE DIAMETER 72 nm | CIRCULARITY 0.92 | VOLUME AVERAGE PARTICLE DIAMETER 67 nm |
| CLEANING BLADE | #1 | 100% MODULUS (B) 3.6 Mpa<br>PURE WATER CONTACT ANGLE (A) 83.2° | COMPARATIVE EXAMPLE 11 | × | COMPARATIVE EXAMPLE 12 | × | COMPARATIVE EXAMPLE 13 | × | COMPARATIVE EXAMPLE 14 | × | COMPARATIVE EXAMPLE 15 | ×× |
| | #2 | 100% MODULUS (B) 4.1 Mpa<br>PURE WATER CONTACT ANGLE (A) 100.6° | COMPARATIVE EXAMPLE 21 | × | EXAMPLE 22 | ○ | EXAMPLE 23 | ○ | EXAMPLE 24 | ○ | COMPARATIVE EXAMPLE 25 | × |
| | #3 | 100% MODULUS (B) 5.5 Mpa<br>PURE WATER CONTACT ANGLE (A) 80.1° | COMPARATIVE EXAMPLE 31 | × | COMPARATIVE EXAMPLE 32 | × | COMPARATIVE EXAMPLE 33 | × | COMPARATIVE EXAMPLE 34 | × | COMPARATIVE EXAMPLE 35 | ×× |
| | #4 | 100% MODULUS (B) 6.6 Mpa<br>PURE WATER CONTACT ANGLE (A) 89.1° | COMPARATIVE EXAMPLE 41 | × | EXAMPLE 42 | ○ | EXAMPLE 43 | ○ | EXAMPLE 44 | ○ | COMPARATIVE EXAMPLE 45 | × |
| | #5 | 100% MODULUS (B) 8.4 Mpa<br>PURE WATER CONTACT ANGLE (A) 78.3° | COMPARATIVE EXAMPLE 51 | × | COMPARATIVE EXAMPLE 52 | × | COMPARATIVE EXAMPLE 53 | × | COMPARATIVE EXAMPLE 54 | × | COMPARATIVE EXAMPLE 55 | ×× |
| | #6 | 100% MODULUS (B) 10.7 Mpa<br>PURE WATER CONTACT ANGLE (A) 82.3° | COMPARATIVE EXAMPLE 61 | × | EXAMPLE 62 | ○ | EXAMPLE 63 | ○ | EXAMPLE 64 | ○ | COMPARATIVE EXAMPLE 65 | × |

FIG. 6

| | | | SILICA PARTICLES | | | | | | | | | |
|---|---|---|---|---|---|---|---|---|---|---|---|---|
| | | | @1 | | @2 | | @3 | | @4 | | @5 | |
| | | | CIRCULARITY 0.46 | VOLUME AVERAGE PARTICLE DIAMETER 415 nm | CIRCULARITY 0.52 | VOLUME AVERAGE PARTICLE DIAMETER 391 nm | CIRCULARITY 0.75 | VOLUME AVERAGE PARTICLE DIAMETER 150 nm | CIRCULARITY 0.89 | VOLUME AVERAGE PARTICLE DIAMETER 72 nm | CIRCULARITY 0.92 | VOLUME AVERAGE PARTICLE DIAMETER 67 nm |
| CLEANING BLADE | #1 | 100% MODULUS (B) 3.6 Mpa<br>PURE WATER CONTACT ANGLE (A) 83.2° | COMPARATIVE EXAMPLE 11 | × | COMPARATIVE EXAMPLE 12 | × | COMPARATIVE EXAMPLE 13 | × | COMPARATIVE EXAMPLE 14 | × | COMPARATIVE EXAMPLE 15 | × |
| | #2 | 100% MODULUS (B) 4.1 Mpa<br>PURE WATER CONTACT ANGLE (A) 100.6° | COMPARATIVE EXAMPLE 21 | × | EXAMPLE 22 | ○ | EXAMPLE 23 | ○ | EXAMPLE 24 | ○ | COMPARATIVE EXAMPLE 25 | × |
| | #3 | 100% MODULUS (B) 5.5 Mpa<br>PURE WATER CONTACT ANGLE (A) 80.1° | COMPARATIVE EXAMPLE 31 | × | COMPARATIVE EXAMPLE 32 | × | COMPARATIVE EXAMPLE 33 | × | COMPARATIVE EXAMPLE 34 | × | COMPARATIVE EXAMPLE 35 | × |
| | #4 | 100% MODULUS (B) 6.6 Mpa<br>PURE WATER CONTACT ANGLE (A) 89.1° | COMPARATIVE EXAMPLE 41 | × | EXAMPLE 42 | ○ | EXAMPLE 43 | ○ | EXAMPLE 44 | ○ | COMPARATIVE EXAMPLE 45 | × |
| | #5 | 100% MODULUS (B) 8.4 Mpa<br>PURE WATER CONTACT ANGLE (A) 78.3° | COMPARATIVE EXAMPLE 51 | × | COMPARATIVE EXAMPLE 52 | × | COMPARATIVE EXAMPLE 53 | × | COMPARATIVE EXAMPLE 54 | × | COMPARATIVE EXAMPLE 55 | × |
| | #6 | 100% MODULUS (B) 10.7 Mpa<br>PURE WATER CONTACT ANGLE (A) 82.3° | COMPARATIVE EXAMPLE 61 | × | EXAMPLE 62 | ○ | EXAMPLE 63 | ○ | EXAMPLE 64 | ○ | COMPARATIVE EXAMPLE 65 | × |

IMAGE FORMING APPARATUS AND REMOVING MEMBER

CROSS-REFERENCE TO RELATED APPLICATIONS

This application is based on and claims priority under 35 USC 119 from Japanese Patent Application No. 2013-054713 filed Mar. 18, 2013.

BACKGROUND

Technical Field

The present invention relates to an image forming apparatus and a removing member.

SUMMARY

According to an aspect of the invention, there is provided an image forming apparatus including a carrier that carries a toner image formed by a toner, the toner including a toner body and an external additive, a circularity of the external additive being about 0.5 to about 0.9, a transfer member that holds a transferred body between the transfer member and the carrier, the transfer member transferring the toner image to the transferred body, and a removing member that includes a contact portion, the contact portion contacting the transfer member, the removing member removing toner that adheres to the transfer member from the toner image carried by the carrier, the contact portion being made of an elastic material that satisfies expression (1) below:

$$A \geq -2.5 \times B + 102 \quad (1)$$

where A denotes a pure water contact angle (°) at 23° C. and 55% RH, and B denotes a 100% modulus (MPa) at 23° C.

BRIEF DESCRIPTION OF THE DRAWINGS

Exemplary embodiments of the present invention will be described in detail based on the following figures, wherein:

FIG. 4 illustrates the results of a test conducted to check for the occurrence of rolling-up of a cleaning blade (rolling-up test of a cleaning blade);

FIG. 6 illustrates the results of a test (cleaning test) conducted to check the cleaning performance of the cleaning blade.

DETAILED DESCRIPTION

First Exemplary Embodiment

Image Forming Apparatus 1

Figure 1:
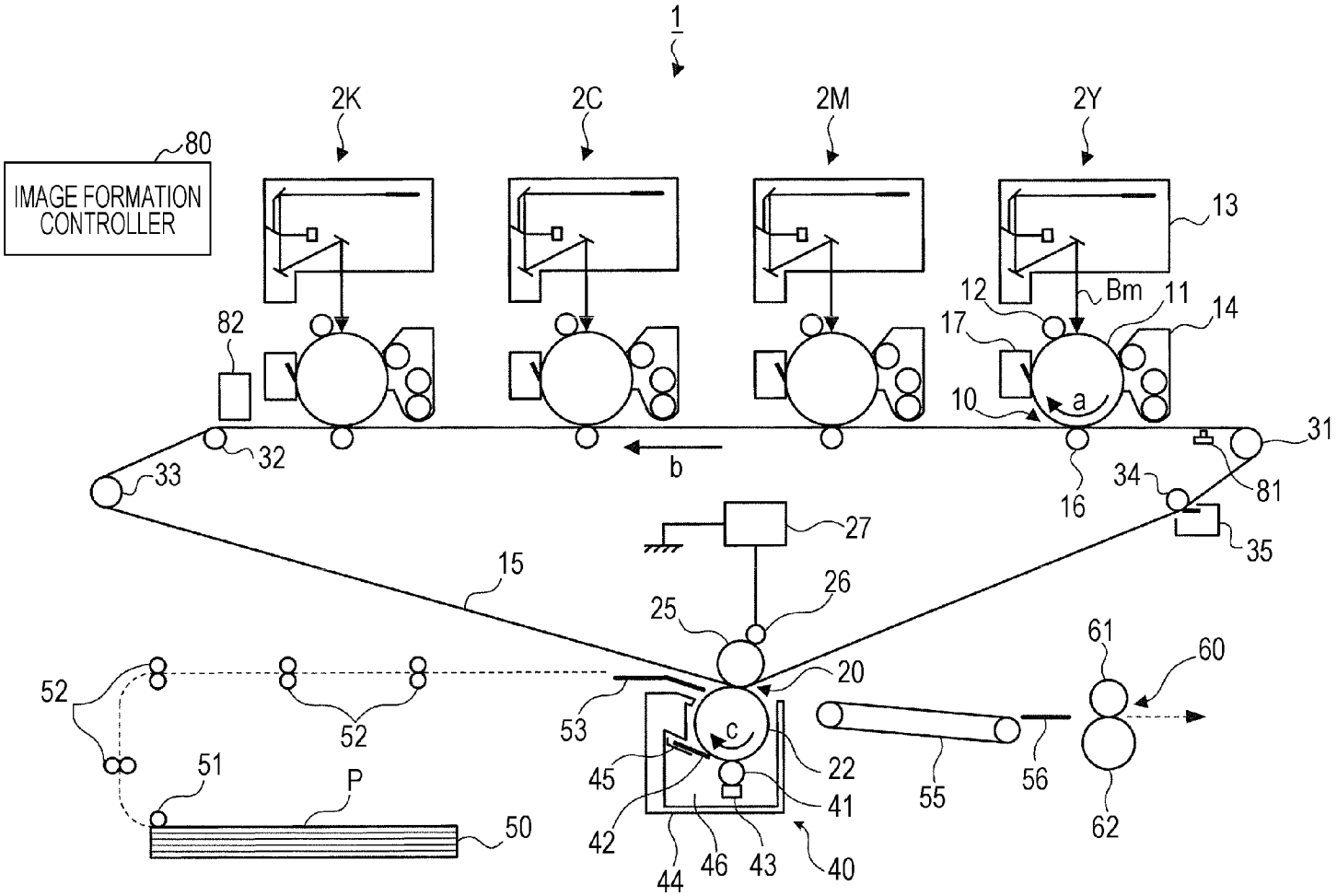
FIG. 1 is a schematic diagram illustrating an example of an image forming apparatus according to a first exemplary embodiment.

FIG. 1 is a schematic diagram illustrating an example of an image forming apparatus 1 according to a first exemplary embodiment. The image forming apparatus 1 illustrated in FIG. 1 is an image forming apparatus employing an intermediate transfer system which is generally of a tandem type. The image forming apparatus 1 includes multiple image forming units 2Y, 2M, 2C, and 2K, a first transfer section 10, a second transfer section 20, and a fixing section 60. In the image forming units 2Y, 2M, 2C, and 2K, toner images of various color components are formed by electrophotography. The first transfer section 10 sequentially transfers the toner images of various colors (color components) formed by the image forming units 2Y, 2M, 2C, and 2K to an intermediate transfer belt 15 that is an example of carrier (first transfer). The second transfer section 20 transfers the toner images (superimposed toner images of various colors) transferred onto the intermediate transfer belt 15, to paper P that is an example of transferred body at once (second transfer). The fixing section 60 fixes the toner image obtained after second transfer onto the paper P. The image forming apparatus 1 also has an image formation controller 80 that controls the operations of various devices (various sections).

The image forming units 2Y, 2M, 2C, and 2K will be referred to as image forming units 2 when it is unnecessary to distinguish between these image forming units.

In each of the image forming units 2Y, 2M, 2C, and 2K, electrophotographic devices such as a charging unit 12, a laser exposure unit 13, a developing unit 14, a first transfer roller 16, and a drum cleaner 17 are sequentially disposed around a photoconductor drum 11 that rotates in the direction of an arrow a. The charging unit 12 electrically charges the corresponding photoconductor drum 11. The laser exposure unit 13 writes an electrostatic latent image onto the photoconductor drum 11 (the exposure beam is denoted by a symbol Bm in FIG. 1). The developing unit 14 stores toners of various colors, and renders an electrostatic latent image on the photoconductor drum 11 visible with the corresponding color. The first transfer roller 16 transfers toner images of various colors formed on the photoconductor drum 11 to the intermediate transfer belt 15 in the first transfer section 10. The drum cleaner 17 removes toner remaining on the photoconductor drum 11. The image forming units 2Y, 2M, 2C, and 2K are arranged in the order of yellow (Y), magenta (M), cyan (C), and black (K) from the upstream side of the intermediate transfer belt 15.

As an example of the charged polarity of toner, the following description assumes that toner is charged to negative polarity (negatively).

The intermediate transfer belt 15 is made of a film-like endless belt having a suitable amount of conductive agent such as carbon black contained in resin such as polyimide or polyamide. The intermediate transfer belt 15 has a volume resistivity of $10^6$ Ωcm to $10^{14}$ Ωcm, and a thickness of, for example, approximately 0.1 mm. The intermediate transfer belt 15 is driven to circulate (rotate) by various rollers at a predetermined speed in the direction of an arrow b illustrated in FIG. 1. The various rollers include a drive roller 31, a support roller 32, a tension roller 33, a backup roller 25, and a cleaning backup roller 34. The drive roller 31 is driven by a motor (not illustrated) with good constant velocity property and rotates the intermediate transfer belt 15. The support roller 32 supports the intermediate transfer belt 15 that extends substantially linearly along the arrangement direction of each photoconductor drum 11. The tension roller 33 applies a predetermined tension to the intermediate transfer belt 15, and functions as a correction roller that prevents meandering of the intermediate transfer belt 15. The backup roller 25 is provided in the secondary transfer section 20. The cleaning backup roller 34 is provided opposite to an intermediate transfer belt cleaner 35 that scrapes off toner remaining on the intermediate transfer belt 15.

The first transfer section 10 is configured by the first transfer roller 16 that is placed opposite to the photoconductor drum 11 across the intermediate transfer belt 15. The first transfer roller 16 includes a shaft, and a sponge layer as an elastic layer that is secured around the shaft. The shaft is a cylindrical bar made of metal such as iron or SUS. The sponge layer is formed of a blended rubber of NBR, SBR, and EPDM in which a conductive agent such as carbon black is blended. The sponge layer is a sponge-like cylindrical roller with a volume resistivity of $10^{71}$ Ωcm to $10^{9}$ Ωcm. The first transfer roller 16 is pressed against the photoconductor drum 11 with the intermediate transfer belt 15 therebetween.

Further, the first transfer roller 16 is applied with a positive voltage (first transfer bias), which is of opposite polarity to the polarity (negative) of the charge on the toner. Consequently, toner images on individual photoconductor drums 11 are electrostatically attracted onto the intermediate transfer belt 15 sequentially, and the toner images are transferred onto the intermediate transfer belt 15 (first transfer).

The second transfer section 20 is configured by a second transfer roller 22 that is an example of transfer member placed opposite to the backup roller 25 across the intermediate transfer belt 15. The second transfer roller 22 is placed on the toner image carrying surface side of the intermediate transfer belt 15, and is grounded. A power supply roller 26 made of metal is placed in contact with the backup roller 25.

The second transfer roller 22 is pressed against the backup roller 25 with the intermediate transfer belt 15 therebetween.

The power supply roller 26 is connected to a second transfer power source 27. When the second transfer power source 27 supplies a negative voltage to the power supply roller 26, the voltage is applied to the backup roller 25. Consequently, a second transfer electric field (second transfer bias) is produced in the second transfer section 20 (between the second transfer roller 22 and the backup roller 25).

When the paper P is transported to the second transfer section 20 in this state, toner images (image-forming toner images 101*a* and 101*b* in FIG. 3 described later) are electrostatically attracted and transferred (second transfer) to the paper P.

While a second transfer bias is an electric field that is formed between the second transfer roller 22 and the backup roller 25 across the intermediate transfer belt 15, it will herein be stated that the second transfer power source 27 supplies a second transfer bias.

As will be described later, depending on the timing, instead of a second transfer bias that is a negative voltage, the second transfer power source 27 supplies a non-transfer electric field (non-transfer bias) of opposite polarity, that is, positive voltage. In this case as well, it will herein be stated that the second transfer power source 27 supplies a non-transfer bias. The non-transfer bias will be described later.

The surface of the backup roller 25 is configured by a tube of blended rubber of EPDM and NBR in which carbon is dispersed. The inside of the backup roller 25 is configured by EPDM rubber. The backup roller 25 has a surface resistivity of $10^{7}$ Ω/sq. to $10^{10}$ Ω/sq. The hardness of the backup roller 25 is set to, for example, 70° (ASKER C).

The second transfer roller 22 includes a shaft, an elastic layer that is secured around the shaft, and a release layer. The shaft is a cylindrical bar made of metal such as aluminum, iron, or SUS. The elastic layer is formed of a blended rubber of NBR, SBR, and EPDM in which a conductive agent such as carbon black is blended. The elastic layer is a sponge-like cylindrical roller with a volume resistivity of $10^{71}$ Ωcm to $10^{9}$ Ωcm. The release layer is made of fluororesin, fluororubber, or the like, and covers the surface of the elastic layer. As the release layer, fluororesin is preferred for its superior releasability.

The surface of the release layer has a surface roughness Rz of not more than 2 μm (Rz≤2 μm).

A roller cleaner 40 that removes toner adhering to the second transfer roller 22 is provided. The roller cleaner 40 includes a cleaning brush 41 and a cleaning blade 42. The cleaning brush 41 is placed rotatably in contact with the second transfer roller 22. The cleaning blade 42 is an example of removing member that is provided further downstream of the cleaning brush 41 in the rotational direction of the second transfer roller 22.

The roller cleaner 40 also includes a lubricant block 43, a cleaner housing 44, and a support member 45. The lubricant block 43 is placed in contact with the cleaning brush 41, and holds the lubricant supplied to the cleaning brush 41. The cleaner housing 44 accommodates the cleaning brush 41, the cleaning blade 42, and the lubricant block 43. The support member 45 secures the cleaning blade 42 to the cleaner housing 44 to thereby support the cleaning blade 42 in place. Further, the roller cleaner 40 has a storage section 46 inside the cleaner housing 44. The storage section 46 stores waste toner.

The cleaning brush 41 is made from a bundle of hair implanted in a spiral into the surface of a shaft made of metal or the like. The hair is made of insulating polypropylene or the like that is easily charged to the same polarity (negative polarity) as that of toner.

The cleaning brush 41 is rotationally driven at a predetermined speed by a drive motor (not illustrated).

Because the lubricant block 43 is placed in contact with the cleaning brush 41, the lubricant held by the lubricant block 43 is supplied to the cleaning brush 41, and as the cleaning brush 41 rotates, the lubricant is further supplied onto the second transfer roller 22. The lubricant is, for example, zinc stearate.

The lubricant reduces friction between the second transfer roller 22 and the cleaning blade 42, and reduces rolling-up of the cleaning blade 42. Rolling-up of the cleaning blade 42 will be described later.

The cleaning blade 42 is an elongated plate-like member made of an elastic material such as urethane rubber. When viewed in lateral section, the cleaning blade 42 is provided so that one corner (edge) of its rectangle contacts the second transfer roller 22 in a direction counter to the rotational direction (arrow c direction) of the second transfer roller 22. Therefore, as the second transfer roller 22 rotates, toner adhering on the second transfer roller 22 is scraped off by one corner of the cleaning blade 42.

The support member 45 secures the cleaning blade 42 to the cleaner housing 44 in such a way that the cleaning blade 42 contacts the second transfer roller 22 with a predetermined pressure (contact pressure).

The toner scraped off by the cleaning blade 42 drops into the storage section 46 inside the cleaner housing 44, and stored as waste toner.

An intermediate transfer belt cleaner 35 is provided on the downstream side of the second transfer section 20 of the intermediate transfer belt 15. The intermediate transfer belt cleaner 35 is able to contact and separate from the intermediate transfer belt 15. The intermediate transfer belt cleaner 35 removes toner or paper dust remaining on the intermediate transfer belt 15 after second transfer, thereby cleaning the surface of the intermediate transfer belt 15. A reference sensor (home position sensor) 81 is arranged on the upstream side of the image forming unit 2Y for yellow Y. The reference sensor 42 generates a reference signal that serves as a reference for establishing the timing of image formation in each of the image forming units 2Y, 2M, 2C and 2K. An image density sensor 82 for adjusting image quality is arranged on the downstream side of the image forming unit 2K for black K.

The reference sensor 81 recognizes a predetermined mark provided on the back side of the intermediate transfer belt 15, and generates a reference signal. The image forming units 2Y, 2M, 2C and 2K begin image formation upon instruction from the image formation controller 80 based on the recognition of this reference signal.

The image density sensor 82 detects a density-control toner image (toner patch) described later. On the basis of the detection result of the density-control toner image detected by the image density sensor 82, the image formation controller 80 adjusts the operating conditions of the image forming units 2Y, 2M, 2C, and 2K, thereby adjusting the density of image-forming toner images described later (image-forming toner images 101*a* and 101*b* illustrated in FIG. 3 described later).

Further, the image forming apparatus 1 according to the exemplary embodiment includes a paper storing section 50, a pickup roller 51, a transport roller 52, a sheet transport path 53, a transport belt 55, and an entry guide 56. The paper storing section 50 stores the paper P. The pickup roller 51 picks up and transports the paper P stored in the paper storing section 50 at predetermined timing. The transport roller 52 transports the paper P paid out by the pickup roller 51. The sheet transport path 53 sends the paper P transported by the transport roller 52 to the second transfer section 20. The transport belt 55 transports the paper P transported to the transport belt 55 by second transfer by the second transport roller 22, to the fixing section 60. The entry guide 56 guides the paper P toward the fixing section 60.

The fixing section 60 includes a heat roller 61 and a pressure roller 62. The heat roller 61 has a built-in heating source such as a halogen lamp. The pressure roller 62 is pressed against the heat roller 61. As the paper P with a transferred toner image is passed between the heat roller 61 and the pressure roller 62, the toner image is fixed to the paper P.

In the image forming apparatus 1 according to the first exemplary embodiment, in addition to image-forming toner images that are transferred to the paper P by second transfer, a gap toner image (gap toner image 102 illustrated in FIG. 3 described later) such as a density-control toner image (toner patch) formed in the space (gap) between successive image-forming toner images, end toner images (toner bands) formed in an end portion of the intermediate transfer belt 15 (end toner images 103*a* and 103*b* illustrated in FIG. 3 described later), and the like are formed. The image-forming toner images, the density-control toner image, and the end toner images will be referred to as toner images when no distinction is made between these toner images.

Next, a basic image forming process by the image forming apparatus 1 according to the first exemplary embodiment will be described. In the following, an image forming process using image-forming toner images will be described, and a gap toner image and end toner images will be described later.

In the image forming apparatus 1 illustrated in FIG. 1, predetermined image processing is applied by an image processing device (not illustrated) to image data outputted from an image reading device (not illustrated), a personal computer (PC) (not illustrated), or the like. Thereafter, image formation is executed by the image forming units 2Y, 2M, 2C, and 2K. The image processing device applies predetermined image processing to inputted image data. The predetermined image processing includes various kinds of image editing such as shading correction, misregistration correction, brightness/color space conversion, gamma correction, frame erasure, color editing, and motion editing. The image data applied with the image processing is converted into color material gradation data of the four colors Y, M, C, and K, and then outputted to the laser exposure unit 13.

The laser exposure unit 13 radiates the exposure beam Bm emitted from, for example, a semiconductor laser, to the photoconductor drum 11 of each of the image forming units 2Y, 2Y, 2M, and 2K, in accordance with the inputted color material gradation data. The surfaces of the respective photoconductor drums 11 of the image forming units 2Y, 2Y, 2M, and 2K are charged by the charging unit 12, followed by scanning and exposure by the laser exposure unit 13, thereby forming electrostatic latent images. The formed electrostatic latent images are developed by the respective developing units 14 of the image forming units 2Y, 2M, 2C, and 2K as image-forming toner images of the colors Y, M, C, and K, respectively.

The image-forming toner images formed on the photoconductor drums 11 of the image forming units 2Y, 2M, 2C and 2K are transferred onto the intermediate transfer belt 15 in the first transfer section 10 where each of the photoconductor drums 11 and the intermediate transfer belt 15 contact each other. More specifically, in the first transfer section 10, the first transfer roller 16 applies a positive voltage (first transfer bias), that is, a voltage of opposite polarity to the polarity (negative) of the charge on the image-forming toner to the base material of the intermediate transfer belt 15, and first transfer is performed whereby the image-forming toner images are sequentially superimposed on the surface of the intermediate transfer belt 15.

As the image-forming toner images of various colors are sequentially transferred to the surface of the intermediate transfer belt 15 by first transfer, the image-forming toner images of various colors are superimposed on one another, and the superimposed image-forming toner images are transported to the second transfer section 20. The pickup roller 51 rotates in synchronization with the timing when the superimposed image-forming toner images are transported to the second transfer section 20, and a sheet of paper P of a predetermined size is supplied from the paper storing section 50. The paper P supplied from the pickup roller 51 is transported by the transport roller 52, and reaches the second transfer section 20 via the sheet transport path 53. Before reaching the second transfer section 20, the paper P is stopped once during transport. At this time, a registration roller (not illustrated) rotates in synchronization with the movement timing of the intermediate transfer belt 15 carrying the superimposed image-forming toner images, thereby performing registration between the paper P and the superimposed image-forming toner images.

In the second transfer section 20, the second transfer roller 22 is pressed against the backup roller 25 via the intermediate transfer belt 15. At this time, the paper P transported to the second transfer section 20 with synchronized timing is nipped between the intermediate transfer belt 15 and the second transfer roller 22. At this time, a negative voltage (second transfer bias), that is, a voltage of the same polarity as the polarity (negative) of the charge on the toner is supplied to the backup roller 25 from the second transfer power source 27 via the power supply roller 26. Then, a second transfer bias is formed between the second transfer roller 22 and the backup roller 25, and second transfer is performed whereby the superimposed image-forming toner images carried on the intermediate transfer belt 15 are transferred onto the paper P at once.

Thereafter, the paper P with the superimposed image-forming toner images is transported while being peeled from the intermediate transfer belt 15 by the second transfer roller 22, and transported to the transport belt 55 provided on the downstream side in the paper transport direction of the second transfer roller 22. The transport belt 55 transports the paper P to the fixing section 60 in accordance with the transport speed in the fixing section 60. As each of the unfixed image-forming toner images on the paper P transported to the fixing section 60 undergoes a fixing process with application of heat and pressure by the fixing section 60, the image-forming toner images are fixed onto the paper P as a fixed image. Then, the paper P with the fixed image is transported to a paper output storing section (not illustrated) provided in an output section of the image forming apparatus 1.

Toner remaining on the intermediate transfer belt 15 after transfer to the paper P is complete is transported as the intermediate transfer belt 15 moves, and is removed from the intermediate transfer belt 15 by the intermediate transfer belt cleaner 35.

Then, toner adhering to the second transfer roller 22 is removed from the second transfer roller 22 by the roller cleaner 40.

[Rolling-Up of Cleaning Blade 42 of Roller Cleaner 40]

Rolling-up of the cleaning blade 42 of the roller cleaner 40 will be described below.

Figure 2B:
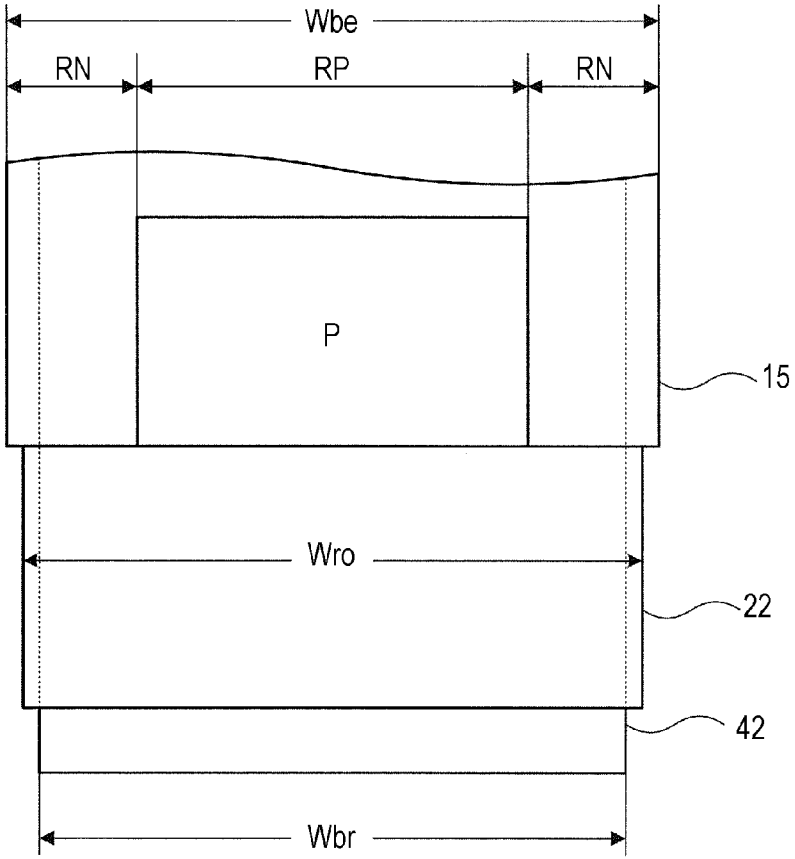
FIGS. 2A and 2B are enlarged views of a second transfer section illustrated in FIG. 1.
Figure 2A:
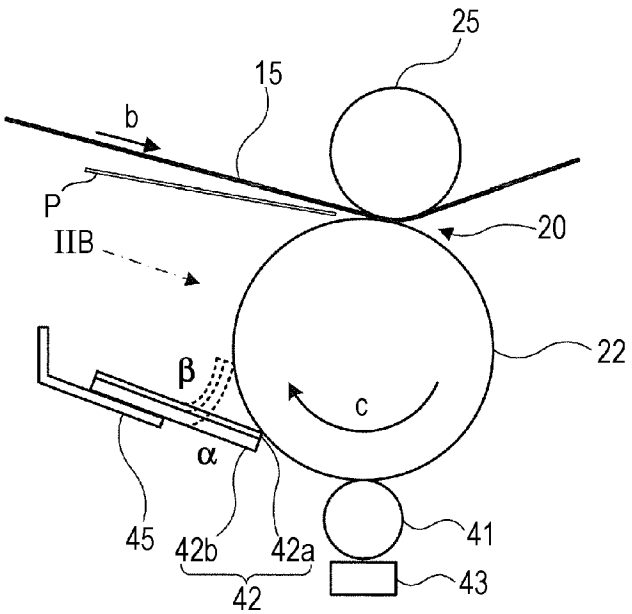

FIGS. 2A and 2B are enlarged views of the second transfer section 20 illustrated in FIG. 1. FIG. 2A illustrates, with the second transfer roller 22 illustrated in FIG. 1 at the center, the intermediate transfer belt 15, the backup roller 25, the cleaning brush 41 of the roller cleaner 40, the cleaning blade 42, the lubricant block 43, the support member 45, and the paper P. FIG. 2B illustrates the second transfer roller 22 as viewed along its width from the direction indicated by an arrow IIB in FIG. 2A. FIG. 2B illustrates the intermediate transfer belt 15, the second transfer roller 22, the cleaning blade 42 of the roller cleaner 40, and the paper P.

As illustrated in FIG. 2A, the cleaning blade 42 of the roller cleaner 40 according to the first exemplary embodiment is a long plate-like member. A corner of the rectangle of the cleaning blade 42 in cross-sectional view taken along the lateral direction is in contact with the second transfer roller 22. Further, the cleaning blade 42 has a two-layer structure including a contact layer 42*a* and a non-contact layer 42*b*. The contact layer 42*a* has a corner that contacts the second transfer roller 22. The non-contact layer 42*b* is stacked on top of the contact layer 42*a* and does not contact the second transfer roller 22. That is, the cleaning blade 42 is arranged so that a corner of the contact layer 42*a* as an example of contact portion is in intimate contact with the surface of the second transfer roller 22 (state α indicated by solid lines).

However, when the distal end portion of the cleaning blade 42 is overcome by the force of rotation of the second transfer roller 22, the distal end portion in the lateral direction of the cleaning blade 42 is rolled up and moves to the downstream side in the rotational direction of the second transfer roller 22 (state β indicated by broken lines). The distal end portion of the cleaning blade 42 refers to the portion of the contact layer 42*a* which is in contact with the second transfer roller 22 and the portion of the non-contact layer 42*b* which is stacked on this portion of the contact layer 42*a*.

When the cleaning blade 42 of the roller cleaner 40 is rolled up, the contact between the cleaning blade 42 and the second transfer roller 22 becomes defective, causing a gap to occur. Then, the cleaning blade 42 becomes unable to remove toner adhering to the second transfer roller 22, with the result that toner remains adhering to the second transfer roller 22. When the paper P passes between the second transfer roller 22 and the intermediate transfer belt 15 in this state, the back surface of the paper P becomes stained with the toner that remains adhering on the second transfer roller 22. That is, a cleaning failure occurs in which the toner adhering on the second transfer roller 22 is not removed. As a result, the toner adhering on the second transfer roller 22 without being removed adheres to the back surface of the paper P, and stains the back surface of the paper P.

That is, rolling-up of the cleaning blade 42 of the roller cleaner 40 causes a cleaning failure of the second transfer roller 22.

Accordingly, in order to mitigate friction between the cleaning blade 42 and the second transfer roller 22 to thereby reduce rolling-up of the cleaning blade 42, lubricant is supplied to the second transfer roller 22 via the cleaning brush 41.

However, the cleaning blade 42 is prone to rolling-up even if lubricant is supplied to the second transfer roller 22.

Next, the second transfer roller 22 as viewed along its width from the direction indicated by the arrow IIB in FIG. 2A will be described with reference to FIG. 2B. In this case, as an example, the width Wbe of the intermediate transfer roller 15 is set larger than the width Wro of the second transfer roller 22 so that the second transfer roller 22 fits within the width Wbe of the intermediate transfer belt 15. In addition, the width Wro of the second transfer roller 22 is set larger than the width Wbr of the cleaning blade 42 so that the cleaning blade 42 fits within the width Wro of the second transfer roller 22.

Therefore, in order to remove toner that has moved to the second transfer roller 22 by the cleaning blade 42, toner images are to be formed in a region of the intermediate transfer belt 15 corresponding to the width Wbr of the cleaning blade 42. In the following description, it is assumed that the width of the region on the intermediate transfer belt 15 where toner images are formed equals the width Wbr of the cleaning blade 42.

The width Wbe of the intermediate transfer belt 15, the width Wro of the second transfer roller 22, and the width Wbr of the cleaning blade 42 may be in a relationship other than that illustrated in FIG. 2B, and the width Wro of the second transfer roller 22 may be the largest. Alternatively, the width Wbr of the cleaning blade 42 may be the largest. The region on the intermediate transfer belt 15 where toner images are formed may be set so that toner adhering to the second transfer roller 22 is removed by the cleaning blade 42.

In this regard, the paper P is placed within the region (width Wbr) on the intermediate transfer belt 15 where toner images are formed. That is, the width of the paper P is smaller than the width Wbr of the region on the intermediate transfer belt 15 where toner images are formed. Accordingly, the region on the intermediate transfer belt 15 where toner images are formed is divided into a paper passage section RP through which the paper P passes, and a non-paper-passage section RN through which the paper P does not pass.

Depending on the case, the rolled-up state β illustrated in FIG. 2A may either occur in the entire cleaning blade 42, or may occur in a part of the cleaning blade 42, for example, in one or both longitudinal end portions of the cleaning blade 42.

As mentioned above, when transferring the image-forming toner images 101 to the paper P, the second transfer bias that is a negative voltage is applied between the second transfer roller 22 and the backup roller 25 across the intermediate transfer belt 15.

At this time, although the paper P exists between these rollers in the paper passage section RP, the paper P does not exist in the non-paper-passage section RN. Consequently, electric discharge is more likely to occur in the non-paper-passage section RN than in the paper passage section RP because the intermediate transfer belt 15 and the second transfer roller 22 are directly opposite to each other in the non-paper-passage section RN.

When electric discharge occurs, products of electric discharge such as nitrogen oxide ($NO_x$) adhere onto the second transfer roller 22 and the intermediate transfer belt 15. The adherence of these products of electric discharge causes the surface energy of the second transfer roller 22 to increase, leading to an increase in the contact friction between the second transfer roller 22 and the cleaning blade 42 of the roller cleaner 40. Consequently, the distal end portion of the cleaning blade 42 is overcome by the rotating force of the second transfer roller 22, causing rolling-up of the cleaning blade 42.

As described above, a cleaning failure of the second transfer roller 22 is caused by rolling-up of the cleaning blade 42 of the roller cleaner 40. Rolling-up of the cleaning blade 42 is caused by an increase in contact friction between the second transfer roller 22 and the cleaning blade 42 of the roller cleaner 40, which occurs as products of electric discharge due to electric discharge occurring in the non-paper-passage section RN adhere to the second transfer roller 22.

Therefore, occurrence of a cleaning failure is reduced if electric discharge in the non-paper-passage section RN is reduced. Moreover, even when electric discharge occurs and products of electric discharge adhere to the second transfer roller 22, if the products of electric discharge are removed, an increase in the contact friction between the second transfer roller 22 and the cleaning blade 42 of the roller cleaner 40 is reduced, thereby reducing occurrence of a cleaning failure.

[Cleaning Blade 42]

As mentioned above, the cleaning blade 42 according to the first exemplary embodiment includes the contact layer 42*a* that contacts the second transfer roller 22, and the non-contact layer 42*b* that is stacked on top of the contact layer 42*a* and does not contact the second transfer roller 22.

The contact layer 42*a* of the cleaning blade 42 is made of an elastic material that satisfies expression (1) below.

$$A \geq -2.5 \times B + 102 \quad (1)$$

where A denotes a contact angle (°) with pure water at 23° C. and 55% RH, and B denotes 100% modulus (MPa) at 23° C. Hereinafter, contact angle with pure water will be referred to as pure water contact angle (A), and 100% modulus will be referred to as 100% modulus (B).

The pure water contact angle (A) is measured as follows. That is, under the environment of 23° C. and 55% RH, pure water is dripped to the surface of the contact layer 42*a* of the cleaning blade 42, and after being left to stand for 10 seconds, the contact angle of the contact layer 42*a* is measured with a contact angle meter CA-X ROLL type (manufactured by Kyowa Interface Science Co., Ltd.). After the contact angle is measured five times while changing the measurement location, the average of the five measurements is determined as the pure water contact angle (A).

The 100% modulus (B) refers to the stress at 100% extension. In this example, a value obtained under the environment of 23° C. by conducting a measurement in conformity with JIS K 6254:92 (vulcanized rubber physical testing direction) is determined as the 100% modulus (B).

For example, the following elastic rubber bodies exist as the kinds of elastic materials that may be used for the contact layer 42*a* of the cleaning blade 42: urethane rubber, silicone rubber, fluororubber, chloroprene rubber, and butadiene rubber. Among these, it is preferred to use urethane rubber (polyurethane elastic body) because of its excellent wear resistance.

As the polyurethane elastic body, generally, polyurethane synthesized through addition reaction of isocyanate, polyol, and various hydrogen containing compounds is used. The polyurethane elastic body is produced as follows. That is, urethane prepolymer is prepared by using, as the polyol component, polyether-based polyol such as polypropylene glycol or polymethylene glycol, or polyester-based polyol such as adipate-based polyol, polycaprolactam-based polyol, or polycarbonate-based polyol, and using, as the polyisocyanate component, aromatic polyisocyanate such as tolylene diisocyanate, 4,4'-diphenylmethane diisocyanate, polymethylene polyphenyl isocyanate, or toluidine diisocyanate, or aliphatic polyisocyanate such as hexamethylene diisocyanate, isophorone diisocyanate, xylylene diisocyanate, or dicyclohexylmethane diisocyanate. A curing agent is added to this urethane prepolymer, and the resulting urethane prepolymer is injected into a predetermined mold for cross-linking and curing, followed by aging at room temperature.

As the curing agent, normally, dihydric alcohol such as 1,4-butanediol, and polyhydric alcohol with more than three hydroxyl groups such as trimethylolpropane or pentaerythritol are used in combination.

A polyurethane elastic body that satisfies expression (1) mentioned above is obtained by adjusting the polyol material, the molecular weight of the polyol, and the materials and compositions of the isocyanate and the cross-linking agent.

Generally speaking, a low molecular weight of polyol leads to a shorter molecular chain length between cross-linking points and reduced micro-Brownian motion, resulting in higher modulus. However, the polarity becomes higher and the contact angle with water becomes lower. Although higher modulus may be accomplished by increasing crosslink density by increasing the amount of cross-linking agent, this again tends to result in lower contact angle with water.

It is difficult to bring the pure water contact angle (A) and the 100% modulus (B) within a range that satisfies expression (1) by simply changing the molecular weight of polyol or adjusting crosslink density. However, the above-mentioned polyurethane elastic body may be produced through combination of the polyol material, the molecular weight of the polyol, and the materials and compositions of the isocyanate and the cross-linking agent mentioned above while ensuring a balance between physical properties.

The 100% modulus (B) of the contact layer 42*a* is preferably set to 4 MPa to 11 MPa while satisfying expression (1).

Further, the pure water contact angle (A) at 23° C. and 55% RH is preferably set to 82° to 101° while satisfying expression (1). If the pure water contact angle (A) is lower than 82°, when the friction of the surface of the second transfer roller 22 becomes very high due to adherence of products of electric discharge, it may not be possible to completely prevent an increase in friction between the cleaning blade 42 and the second transfer roller 22 in some cases. A pure water contact angle (A) higher than 101° tends to lead to accelerated wear due to a decrease in the cohesive force between rubber molecules.

The non-contact layer 42*b* of the cleaning blade 42 is made of an elastic material with a low 100% modulus (B) in comparison to the contact layer 42*a*.

Because the cleaning blade 42 includes the contact layer 42*a* and the non-contact layer 42*b* that differ in their 100% modulus (B), vibration in the distal end portion of the cleaning blade 42 may be absorbed. In addition, it is possible to adjust the pressure with which the cleaning blade 42 contacts the second transfer roller 22, thereby making it possible to control deformation of the distal end portion of the cleaning blade 42.

It is preferred that the non-contact layer 42*b* have a 100% modulus (B) at 23° C. of 3 to 6 MPa.

The thickness of the contact layer 42*a* of the cleaning blade 42 including the contact layer 42*a* and the non-contact layer 42*b* that are stacked together is preferably not more than 25%, and more preferably not more than 20%, of the total thickness of the cleaning blade 42.

The total thickness of the cleaning blade 42 is preferably 1.0 mm to 4.0 mm, and more preferably 1.5 mm to 3.0 mm.

While FIG. 2A illustrates the cleaning blade 42 as a multilayer body of the contact layer 42*a* and the non-contact layer 42*b*, the cleaning blade 42 may be a single-layer body including only the contact layer 42*a*. It is to be noted that the contact layer 42*a* is made of an elastic material that satisfies expression (1).

However, as mentioned above, adjusting the respective 100% moduli of the contact layer 42*a* and non-contact layer 42*b* makes it easy to adjust deformation or dynamic tracking property of the distal end portion of the cleaning blade 42. Therefore, the cleaning blade 42 may be formed as a multilayer body.

Further, the cleaning blade 42 may be formed as a multilayer body with three or more layers.

As illustrated in FIG. 1, the cleaning blade 42 is secured to the cleaner housing 44 by the support member 45. The contact pressure with which the cleaning blade 42 contacts the second transfer roller 22 is controlled by the support member 45. The support member 45 is configured to provide stable contact pressure without being affected by sagging due to the usage environment or long-term storage.

The angle at which the cleaning blade 42 attached to the support member 45 contacts the second transfer roller 22 is preferably 5° to 30°.

Moreover, the contact pressure with which the cleaning blade 42 contacts the second transfer roller 22 is preferably 9.8 kPa to 49.0 kPa.

[Toner Images]

Figure 3:
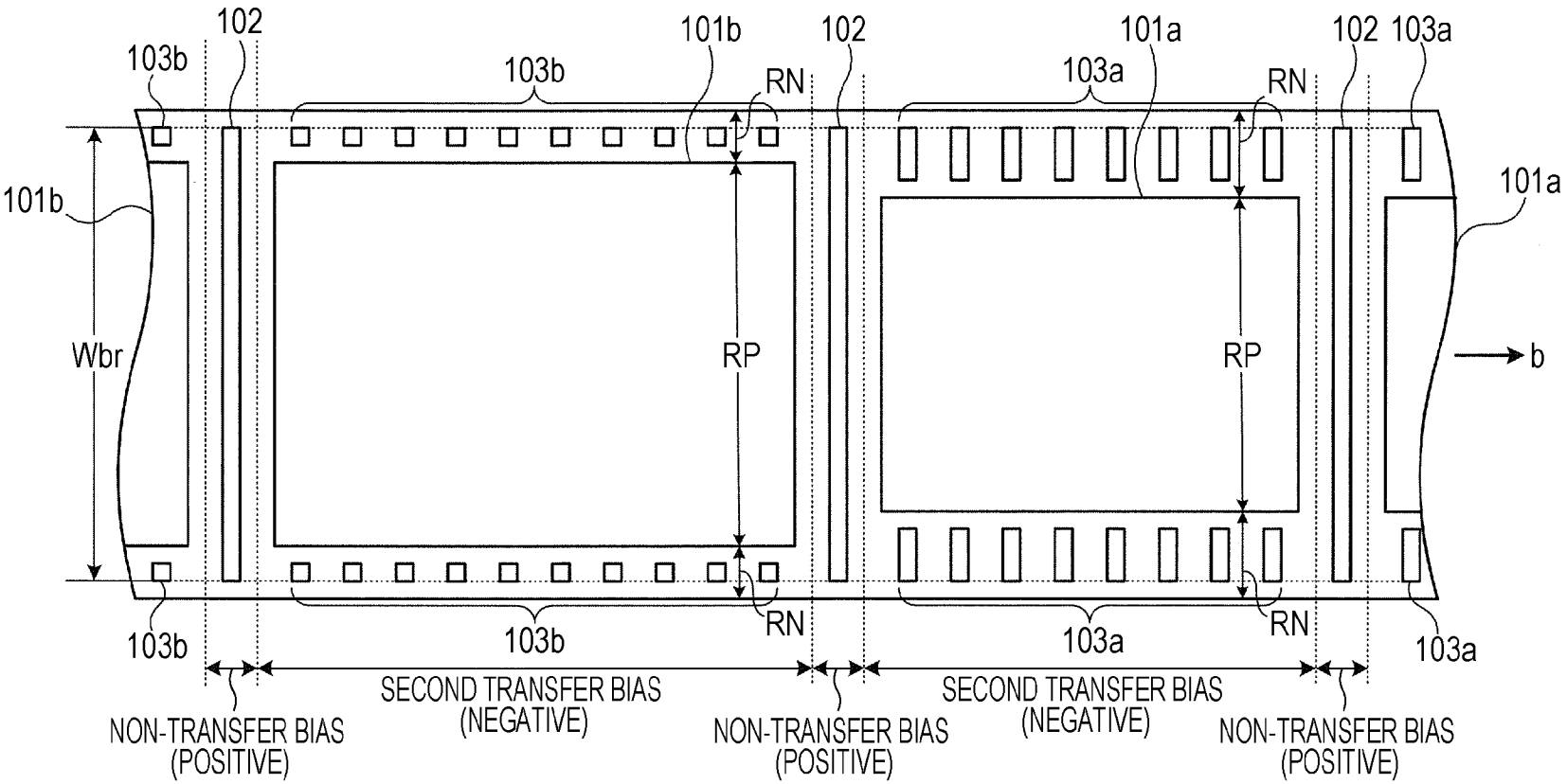
FIG. 3 illustrates an example of toner images on an intermediate transfer belt.

FIG. 3 illustrates an example of toner images on the intermediate transfer belt 15. FIG. 3 illustrates a part of the surface of the intermediate transfer belt 15 in the second transfer section 20, as viewed from the second transfer roller 22 side. The intermediate transfer belt 15 moves in the direction of an arrow b. In a case where the image forming apparatus 1 supports, for example, A3 wide-size (for example, 329 mm×483 mm) paper P, the width Wbr of an region on the intermediate transfer belt 15 where toner images are formed is set larger than 329 mm, for example, 380 mm.

As illustrated in FIG. 3, in addition to the image-forming toner images 101*a* and 101*b* that are to be transferred to the paper P by second transfer, the intermediate transfer belt 15 carries the gap toner image 102 such as a density-control toner image provided (in the gap) between the image-forming toner images 101*a* and 101*b*, and the end toner images 103*a* and 103*b* that are provided as toner bands in opposite end portions of the intermediate transfer belt 15. As described above, the image-forming toner images 101*a* and 101*b*, the gap toner image 102, and the end toner images 103*a* and 103*b* will be referred to as "toner images" when no distinction is made between these toner images.

In FIG. 3, the image-forming toner images 101*a* and 101*b* are provided in the central portion in the width direction of the intermediate transfer belt 15. The image-forming toner image 101*a* and the image-forming toner image 101*b* differ in their size. That is, the area of the image-forming toner image 101*a* is depicted smaller than the area of the image-forming toner image 101*b*. While these toner images are to be transferred to the paper P, these toner images correspond to different sizes of paper P. For example, the image-forming toner image 101*a* corresponds to A4-size (210 mm×297 mm) paper P, and the image-forming toner image 101*b* corresponds to A3-size (297 mm×420 mm) paper P.

The image-forming toner images 101*a* and 101*b* will be referred to as "image-forming toner images 101" when no distinction is made between these toner images.

The image-forming toner images 101 may be located near one end side in the width direction of the intermediate transfer belt 15.

The gap toner image 102 is provided in the gap between successive image-forming toner images 101. The gap toner image 102 may be a density-control toner image that is readable by the image density sensor 82 used for adjusting image quality, or may include a density-control toner image.

A density-control toner image may not necessarily be provided in every gap between successive image-forming toner images 101 but may be provided when density control becomes necessary.

Even in a case where a density-control toner image is not provided, like the end toner images 103 described later, the gap toner image 102 may be provided as a toner image for reducing rolling-up of the cleaning blade 42 of the roller cleaner 40.

In the present example, each of a density-control toner image provided in the gap between the image-forming toner images 101, and a toner image used for reducing rolling-up of the cleaning blade 42 of the roller cleaner 40 will be referred to as the gap toner image 102.

In FIG. 3, the gap toner image 102 is provided continuously from one end portion of a region (width Wbr) of the intermediate transfer belt 15 where toner images are formed, to the other end portion. The length and width of the gap toner image 102 along the movement direction (direction of the arrow b) of the intermediate transfer belt 15 are, for example, 3 mm and 380 mm, respectively. However, the gap toner image 102 may be divided into multiple sections in one or both of the width and longitudinal directions of the intermediate transfer belt 15.

The end toner images 103*a* and 103*b* are provided on the outside of the image-forming toner images 101 in opposite end portions in the width direction of the intermediate transfer belt 15. In FIG. 3, the end toner images 103*a* and 103*b* that have the same shape are provided symmetrically with respect to the center line of the width direction of the intermediate transfer belt 15. This is because the image-forming toner images 101 are provided in the central portion of the width direction of the intermediate transfer belt 15.

For example, the end toner images 103*a* and 103*b* are located discretely with respect to the movement direction (direction of the arrow b) of the intermediate transfer belt 15.

The widths of the end toner images 103*a* and 103*b* in the width direction of the intermediate transfer belt 15 correspond to the widths of the image-forming toner images 101*a* and 101*b*, respectively. The image-forming toner image 101*a* corresponding to A4-size paper P has a small width in the width direction of the intermediate transfer belt 15 in comparison to the image-forming toner image 101*b* corresponding to A3-size paper P. Therefore, the end toner image 103*a* corresponding to the image-forming toner image 101*a* has a width in the width direction of the intermediate transfer belt 15 which is set larger than the width in the width direction of the end toner image 103*b* corresponding to the image-forming toner image 101*b*.

That is, the end toner images 103*a* and 103*b* are provided so as to cover regions on the intermediate transfer belt 15 which are not occupied by the image-forming toner images 101.

The end toner images 103*a* and 103*b* will be referred to as "end toner images 103" when no distinction is made between these toner images.

In a case where the image-forming toner images 101 are provided in one end portion with respect to the width direction of the intermediate transfer belt 15, the end toner images 103 may be provided in the other end portion in the width direction of the intermediate transfer belt 15.

Next, an electric field (bias) applied between the second transfer roller 22 and the backup roller 25 by the second transfer power source 27 as illustrated in FIG. 3 will be described.

When each of the image-forming toner images 101*a* and 101*b* to be transferred to the paper P passes through the second transfer section 20, the second transfer power source 27 supplies a second transfer bias that is a negative voltage to the backup roller 25 via the power supply roller 26. The second transfer bias is formed between the backup roller 25 and the second transfer roller 22 across the intermediate transfer belt 15.

The paper P corresponding to each of the image-forming toner images 101*a* and 101*b* is supplied between the intermediate transfer belt 15 and the second transfer roller 22. Therefore, the second transfer bias that is a negative voltage presses negatively charged toner forming each of the image-forming toner images 101*a* and 101*b* on the intermediate transfer belt 15, onto the paper P side.

This second transfer bias also acts on the toner forming each of the end toner images 103*a* and 103*b* that are located in parallel to the image-forming toner images 101*a* and 101*b*, respectively, in the width direction of the intermediate transfer belt 15. However, because there is no paper P in locations corresponding to the end toner images 103*a* and 103*b*, the second transfer bias presses the toner forming each of the end toner images 103*a* and 103*b* against the second transfer roller 22. Consequently, the toner forming each of the end toner images 103*a* and 103*b* adheres onto the second transfer roller 22.

That is, in a period during which the second transfer bias is applied, in the central portion (paper passage section RP) of the second transfer roller 22, the image-forming toner images 101*a* and 101*b* are transferred to the paper P, and in either end portion (non-paper-passage section RN) of the second transfer roller 22, the end toner images 103*a* and 103*b* adhere to (are transferred to) the second transfer roller 22. As illustrated in FIG. 3, the respective widths of the paper passage section RP and non-paper-passage section RN in the width direction of the intermediate transfer belt 15 vary with the width of the paper P.

Although the end toner images 103*a* and 103*b* adhere to (are transferred to) the second transfer roller 22, the end toner images 103*a* and 103*b* do not adhere 100% to the second transfer roller 22 but partially remain on the intermediate transfer belt 15.

The image-forming toner images 101*a* and 101*b* are not 100% transferred to the paper P, either, but partially remain on the intermediate transfer belt 15.

When the gap toner image 102 passes through the second transfer section 20, the second transfer power source 27 supplies a non-transfer that is a positive voltage to the backup roller 25. Consequently, the non-transfer bias formed in the second transfer section 20 acts so as to press the toner forming the gap toner image 102 onto the intermediate transfer belt 15 side. That is, the gap toner image 102 remains on the intermediate transfer belt 15.

However, because there is no paper P in a location corresponding to the gap toner image 102, the gap toner image 102 comes into contact with the second transfer roller 22. Therefore, a part of the gap toner image 102 adheres to the second transfer roller 22.

As described above, the second transfer power supply 27 switches between a negative voltage (second transfer bias) and a positive voltage (non-transfer bias), and supplies one of the voltages.

For example, the second transfer bias is −12 kV, and the non-transfer bias is 1 kV.

Now, the reason for providing the end toner images 103 will be described.

As described above, in the paper passage section RP, a second transfer bias is applied via the paper P. Because no paper P exists in the non-paper-passage section RN, the second transfer bias is applied between the second transfer roller 22 and the intermediate transfer belt 15. The gap between the second transfer roller 22 and the intermediate transfer belt 15 corresponds to the thickness of the paper P.

Because the second transfer bias is, for example, −12 kV, electric discharge tends to occur in the non-paper-passage section RN where a gap corresponding to the thickness of the paper P exists.

Accordingly, the end toner images 103 are provided in the non-paper-passage section RN, toner is moved to the second transfer roller 22, and toner including an inorganic external additive and the like is supplied to the cleaning blade 42. By making the external additive exist between the second transfer roller 22 and the cleaning blade 42 in this way, the contact friction of the cleaning blade 42 is reduced, and the ease of removal of adhering products of electric discharge is improved, thereby reducing deposition of products of electric discharge. As a result, rolling-up of the cleaning blade 42 due to increased friction between the second transfer roller 22 and the cleaning blade 42 is reduced, thereby reducing a cleaning failure of the second transfer roller 22.

By providing the end toner images 103, toner forming the end toner images 103 adheres to the surface corresponding to the non-paper-passage section RN of the second transfer roller 22. Because the end toner images 103 adhere (move)

onto the second transfer roller 22, the end toner images 103 are removed by the roller cleaner 40.

The reason for providing the gap toner image 102 will be described.

Because there is no paper P in the gap between successive image-forming toner images 101, the state in the gap is the same as that of the non-paper-passage section RN where the end toner images 103 are provided. However, in a period during which the gap toner image 102 passes through the second transfer section 20, a positive non-transfer bias is applied between the intermediate transfer belt 15 and the second transfer roller 22. The non-transfer bias is, for example, 1 kV, and its absolute value is small in comparison to the second transfer bias that is −12 kV. However, there is a possibility that electric discharge may occur. Therefore, the gap toner image 102 is provided to thereby reduce occurrence of electric discharge and the resulting generation of products of electric discharge such as nitrogen oxide ($NO_x$).

For this reason, the gap toner image 102 may be provided even in cases where no density-control toner image is provided.

As described above, the gap toner image 102 and the end toner images 103 are provided for the purpose of reducing occurrence of electric discharge between the intermediate transfer belt 15 and the second transfer roller 22, and reducing rolling-up of the cleaning blade 42. Therefore, the gap toner image 102 and the end toner images 103 may be set by taking into consideration the reduction of rolling-up of the cleaning blade 42 that may be accomplished and consumption of toner. In this case, for example, as illustrated in FIG. 3, the end toner images 103 are provided discretely along the movement direction (direction of the arrow b) of the intermediate transfer belt 15 to thereby reduce consumption of toner.

That is, the image-forming toner images 101 are an example of first toner image that is transferred to the paper P, and the gap toner image 102 and the end toner images 103 are an example of second toner image that is not transferred to the paper P.

[Toner]

Toner according to the first exemplary embodiment includes a toner body, and an external additive that adheres to the surface of the toner body. The term "toner body" refers to the portion of toner excluding the external additive.

The external additive according to the first exemplary embodiment has a volume average particle diameter of not less than 70 nm and not more than 400 nm, and an average circularity of not less than 0.5 and not more than 0.9. Because the average circularity deviates from 1 (circle) and is less than 1 in this case, the external additive will be referred to as irregular-shaped external additive.

By means of the irregular-shaped external additive, nitrogen oxide ($NO_x$) or the like as products of electric discharge adhering to the second transfer roller 22 is abraded and removed.

As the irregular-shaped external additive according to the first exemplary embodiment, in a case where the toner body is charged to negative polarity, it is possible to use, for example, silica that has the same charge polarity and is easily charged negatively, and in a case where the toner body is charged to positive polarity, it is possible to use, for example, cerium dioxide or strontium titanate that has the same charge polarity and is easily charged to positive polarity.

If the toner body and the external additive have the same charge polarity, the toner body and the external additive are charged simultaneously, and thus easily transferred together without separating from each other.

Because it is assumed herein that toner is charged to negative polarity, silica that is easily charged negatively may be used as the toner. Therefore, herein, silica particles made of silica will be described as an example of external additive.

Hereinafter, silica particles will be described as an example of irregular-shaped external additive. The silica particles may be any particles whose principal component is $SiO_2$, and may be either of crystalline and amorphous. Further, the particles may be particles produced by using a silicon compound such as water glass or alkoxysilane as a raw material, or may be particles obtained by grinding quartz.

<Silica Particles>

The silica particles have a volume average particle diameter of not less than 70 nm and not more than 400 nm. If the silica particles have a volume average particle diameter of less than 70 nm, the silica particles tend to become buried in the surface of the toner body owing to shear stress exerted on toner inside the developing unit 14. As a result, even when toner is supplied to the surface of the second transfer roller 22, it may not be possible to break the silica particles away from the toner with the cleaning blade 42, making it difficult for the toner particles to exert a force (abrasive force) that abrades the surface of the second transfer roller 22. If the silica particles have a volume average particle diameter exceeding 400 nm, the silica particles easily break away from the toner body owing to shear stress exerted inside the developing unit 14, or the electric field applied during first transfer or second transfer, making it difficult to transport toner to the surface of the second transfer roller 22 in a state in which the silica particles are retained by the toner body. Therefore, it is difficult for the toner particles to exert a force (abrasive force) that abrades the second transfer roller 22.

The volume average particle diameter of the silica particles may be measured by using an LS Coulter (particle size analyzer manufactured by Beckman Coulter Inc.). The measured particle size distribution is divided into multiple particle size ranges (channels), and for each divided particle size range, a cumulative distribution is drawn from the small diameter side with respect to the volume of each individual particle, and the particle diameter at the 50% cumulative frequency is defined as the volume average particle diameter (D50v).

The silica particles preferably have an average circularity of not less than 0.5 and not more than 0.9. If the average circularity exceeds 0.9, the silica particles have a spherical shape, and are unevenly distributed in depressions of the toner body. Consequently, even when toner is supplied to the surface of the second transfer roller 22, it is difficult to break the silica particles away from the toner body with the cleaning blade 42. Even when toner is supplied to the portion of the roller cleaner 40, the silica particles are nearly spherical in shape, and hence it is difficult for the silica particles to exert a force (abrasive force) that abrades the second transfer roller 22. If the average circularity is less than 0.5, the silica particles abrade (chip) the surface of the second transfer roller 22 unevenly, causing abrasion scars (chipping scars).

The circularity of silica particles is obtained as "100/SF2" calculated by expression (2) below, from an image obtained by observation, with an SEM, of the silica particles after being dispersed on resin particle bodies (for example, poly ester resin with a weight average molecular weight Mw=50,000) having a volume average particle diameter of 100 μm:

$$\text{Circularity } (100/SF2)=4\pi\times(S/I^2) \quad (2)$$

where I denotes the circumferential length of the silica particles in the image, and S denotes projected area.

The average circularity of the silica particles is obtained as the 50% circularity at the cumulative frequency of the circularities of 100 silica particles obtained by image analysis.

Next, the toner body will be described.

<Toner Body>

As the toner body, thermoplastic resin made of various kinds of natural or synthetic polymer substances may be used. For example, the following resins are used singularly or in combination: polyolefin resin such as polyethylene or polypropylene; polystyrene resin such as polystyrene or copolymer of acrylonitrile-butadiene-styrene (ABS resin); acrylic resin such as polymethyl methacrylate or polyacrylic butyl; rubber-like (co)polymer such as polybutadiene or polyisoprene; polyester resin such as polyethylene terephthalate; polyvinyl chloride resin; vinyl aromatic resin; conjugated diene resin; polyamide resin; polyacetal resin; polycarbonate resin; thermoplastic polyurethane resin; and fluororesin.

Typically, epoxy resin, styrene-acrylic resin, polyamide resin, polyester resin, polyvinyl resin, polyolefin resin, polyurethane resin, polybutadiene resin, and the like with a weight average molecular weight of not less than 5,000 and not more than 100,000 are used singularly or in combination.

Among these, polyester resin and acrylic resin are more preferred.

The toner body may contain additives such as inorganic particles other than silica particles as an irregular-shaped external additive, an ultraviolet absorber, and an oxidation inhibitor.

<Toner Producing Method>

A toner producing method includes a silica particle producing method, a toner body producing method, and a silica particle adhering method for adhering silica particles to the toner body. Hereinafter, these methods will be described in the stated order.

—Silica Particle Producing Method—

A method of producing silica particles is not particularly limited insofar as the silica particles obtained by this method have a volume average particle diameter of not less than 70 nm and not more than 400 nm, and an average circularity of not less than 0.5 and not more than 0.9.

For example, the silica particles may be produced by a dry method in which silica particles having a volume average particle diameter exceeding 300 nm are ground and classified, or by a so-called wet method in which particles are produced by a sol-gel method from a silicon compound such as alkoxysilane as a raw material. Examples of the wet method include, in addition to a sol-gel method, a method of obtaining a silica sol using water glass as a raw material.

As an example, a method of producing silica particles by a sol-gel method using alkoxysilane will be described below.

An alkali catalyst solution having an alkali catalyst contained in a solvent containing alcohol is prepared. When tetraalkoxysilane and an alkali catalyst are supplied to this solution, the tetraalkoxysilane supplied into the alkali catalyst solution reacts, and nuclear particles are generated. If the concentration of the alkali catalyst in the alkali catalyst solution is not less than 0.6 mol/L and not more than 0.85 mol/L at this time, irregular-shaped nuclear particles are generated while suppressing generation of coarse aggregates such as secondary aggregates.

Then, as the supply of tetraalkoxysilane and the supply of alkali catalyst are continued, the generated nuclear particles grow owing to the reaction of tetraalkoxysilane, and irregular-shaped silica particles are obtained as a result.

—Toner Body Producing Method—

The toner body may be produced by, for example, either one of the following methods: a method of hot-melt kneading resin that is to become the toner body, followed by grinding and classification (kneading and grinding method); a method of suspending and dispersing an oil phase, which is obtained by dissolving resin that is to become the toner body in an aqueous organic solvent, in an aqueous phase containing a dispersant, and then removing the solvent (dissolution and suspension method); and a method of coagulating resin obtained by emulsion polymerization or the like from monomer of resin that is to become the toner body, into particle form (emulsion polymerization and coagulation method).

In a case where various components such as inorganic particles are to be contained in the toner body, the resin that is to become the toner body and the various components may be mixed together in advance. In a case where the emulsion polymerization and coagulation method is employed, monomer of resin that is to become the toner body and the various components may be mixed together for emulsion polymerization in advance.

—Silica Particle Adhering Method—

Next, the obtained silica particles are adhered to the surface of the toner body.

As a silica particle adhering method for adhering silica particles to the surface of the toner body, there is, for example, a method of adding the silica particles, the toner body, and an adherent component as necessary are loaded into to a V-blender, a Henschel mixer, a Loedige mixer, or the like and stirred. The silica particles may be adhered to the surface of the toner body in multiple steps.

Toner adhering to the surface of the second transfer roller 22 rubs the surface of the second transfer roller 22 when removed by the cleaning blade 42. That is, if toner includes an irregular-shaped external additive, the external additive abrades (chips) the surface of the second transfer roller 22 when the cleaning blade 42 removes the toner adhering to the surface of the second transfer roller 22. Therefore, even if products of electric discharge such as nitrogen oxide ($NO_x$) adhere onto the second transfer roller 22 of the second transfer section 20 owing to electric discharge, the products of electric discharge may be chipped away by the irregular-shaped external additive included in the toner when removing the toner by the cleaning blade 42. This prevents the products of electric discharge adhering on the second transfer roller 22 and the cleaning blade 42 of the roller cleaner 40 from rubbing against each other to cause wear of the distal end portion of the cleaning blade 42, creating irregularities.

In the first exemplary embodiment, the end toner images 103 adhere onto the second transfer roller 22 owing to the second transfer bias. Consequently, toner forming the end toner images 103 may be used as an abrasive that abrades the surface of the second transfer roller 22. Because the end toner images 103 are formed in the non-paper-passage section RN, it is possible to abrade the non-paper-passage section RN of the second transfer roller 22 where electric discharge is likely to occur.

Although the gap toner image 102 is unlikely to adhere onto the second transfer roller 22 owing to the non-transfer bias, a part of the gap toner image 102 adheres to the surface of the second transfer roller 22. Therefore, toner forming the gap toner image 102 may be used as an abrasive that abrades the surface of the second transfer roller 22 to thereby abrade the paper passage section RP of the second transfer roller 22.

In this way, creation of large irregularities in the surface of the non-paper-passage section RN such as either end portion of the second transfer roller 22 is reduced, thereby reducing rolling-up of the cleaning blade 42. Further, occurrence of a so-called cleaning failure is reduced. A cleaning failure refers to a situation where toner that has adhered (moved) onto the second transfer roller 22 owing to a gap created by rolling-up of the cleaning blade 42 adheres to the back surface of the paper P without being removed.

Next, examples according to the first exemplary embodiment will be described.

Six kinds of cleaning blades 42 are prepared by the above-mentioned method. These cleaning blades 42 differ in the pure water contact angle (A) and 100% modulus (B) of the contact layer 42*a* that contacts the second transfer roller 22.

Further, five kinds of toner are prepared by the above-mentioned method. Each of these kinds of toner differs in the volume average particle diameter and circularity of an external additive contained in the corresponding kind of toner.

Then, whether or not rolling-up of the cleaning blade 42 has occurred and whether or not a cleaning failure has occurred are evaluated for 30 combinations of the six kinds of cleaning blades 40 and the five kinds of external additives.

[Rolling-Up Test of Cleaning Blade 42]

FIG. 4 illustrates the results of a test conducted to check for the occurrence of rolling-up of the cleaning blade 42 (rolling-up test of the cleaning blade 42). In FIG. 4, six kinds of cleaning blades 42 (#1 to #6) are arranged vertically in order from smallest to largest in terms of their 100% modulus (B) that ranges from 3.6 MPa to 10.7 MPa.

The cleaning blade 42 denoted by #1 has a 100% modulus (B) of 3.6 MPa, and a pure water contact angle (A) of 83.2°. The cleaning blade 42 denoted by #2 has a 100% modulus (B) of 4.1 MPa, and a pure water contact angle (A) of 100.6°. The cleaning blade 42 denoted by #3 has a 100% modulus (B) of 5.5 MPa, and a pure water contact angle (A) of 80.1°. The cleaning blade 42 denoted by #4 has a 100% modulus (B) of 6.6 MPa, and a pure water contact angle (A) of 89.1°. The cleaning blade 42 denoted by #5 has a 100% modulus (B) of 8.4 MPa, and a pure water contact angle (A) of 78.3°. The cleaning blade 42 denoted by #6 has a 100% modulus (B) of 10.7 MPa, and a pure water contact angle (A) of 82.3°.

The relationship between the pure water contact angle (A) and 100% modulus (B) of the cleaning blade 42 will be described later.

Further, silica particles (@1 to @5) as external additives contained in the five kinds of toner are arranged horizontally in order from smallest to largest in terms of their circularity that ranges from 0.46 to 0.92.

The silica particles denoted by @1 have a circularity of 0.46, and a volume average particle diameter of 415 nm. The silica particles denoted by @2 have a circularity of 0.52, and a volume average particle diameter of 391 nm. The silica particles denoted by @3 have a circularity of 0.75, and a volume average particle diameter of 150 nm. The silica particles denoted by @4 have a circularity of 0.89, and a volume average particle diameter of 72 nm. The silica particles denoted by @5 have a circularity of 0.92, and a volume average particle diameter of 67 nm. In this case, the volume average particle diameter of silica particles vary in inverse correlation with the circularity. That is, the smaller the circularity, the larger the volume average particle diameter, and the larger the circularity, the smaller the volume average particle diameter. The volume average particle diameter is 415 nm when the circularity is 0.46, whereas the volume average particle diameter is 67 nm when the circularity is 0.92.

The rolling-up test is carried out under the environment of 28° C. and 80% RH. The paper P used has an A4 size with a basis weight of 200 g/m$^2$. The dot percent (Cin) of image-forming toner images is 0.5% for each of the colors Y, M, C, and K. The contact pressure of the cleaning blade 42 with the second transfer roller 22 is 29.4 kPa. Image-forming toner images are formed on 3,000 sheets of paper P, and whether or not rolling-up of the cleaning blade 42 has occurred is checked.

In the evaluation, cases where rolling-up has not occurred in the cleaning blade 42 are evaluated as "○", cases where rolling-up has occurred in the cleaning blade 42 between 2,000 to 3,000 sheets are evaluated as "Δ", cases where rolling-up has occurred in the cleaning blade 42 between 500 to 2,000 sheets are evaluated as "x", and cases where rolling-up has occurred in the cleaning blade 42 below 500 sheets are evaluated as "xx". Further, cases evaluated as "○" are defined as "Examples" and cases evaluated as "Δ", "x", and "xx" are defined as "Comparative Examples". Combinations of the respective numbers of the identification symbols (#1 to #6) of the cleaning blade 42 and of the identification symbols (@1 to @5) of the silica particles are added to "Examples" and "Comparative Examples" to differentiate between these examples.

As illustrated in FIG. 4, for the cleaning blades 42 denoted by #1, #3, and #5, when used in combination with the silica particles denoted by @1 to @4, their evaluation is "x" (Comparative Examples 11, 12, 13, 14, 31, 32, 33, 34, 51, 52, 53, and 54). When the cleaning blades 42 denoted by #1, #3, and #5 are used in combination with the silica particles denoted by #5, their evaluation is "xx" (Comparative Examples 15, 35, and 55).

From these findings, it is appreciated that as the circularity of silica particles becomes closer to 1 like the silica particles denoted by @5 having a circularity of 0.92, rolling-up of the cleaning blade 42 becomes more likely to occur.

For the cleaning blades 42 denoted by #2, #4, and #6, when used in combination with the silica particles denoted by @1 and @5, their evaluation is "x" (Comparative Examples 21, 25, 41, 45, 61, and 65), whereas their evaluation is "○" when used in combination with the silica particles denoted by @2 to @4 (Examples 22, 23, 24, 42, 43, 44, 62, 63, and 64).

From these findings, it is appreciated that rolling-up of the cleaning blade 42 is likely to occur both when the circularity of the silica particles is small in comparison to 1 like the silica particles denoted by @1 that have a circularity of 0.46, and when the circularity of the silica particles is close to 1 like the silica particles denoted by @5 that have a circularity of 0.92.

Further, it is appreciated that rolling-up of the cleaning blade 42 is unlikely to occur when the circularities are 0.52, 0.75, and 0.89, like the silica particles denoted by @2, @3, and @4, respectively. That is, use of toner containing silica particles with a circularity ranging from 0.50 to 0.90 reduces occurrence of rolling-up of the cleaning blade 42.

Figure 5:
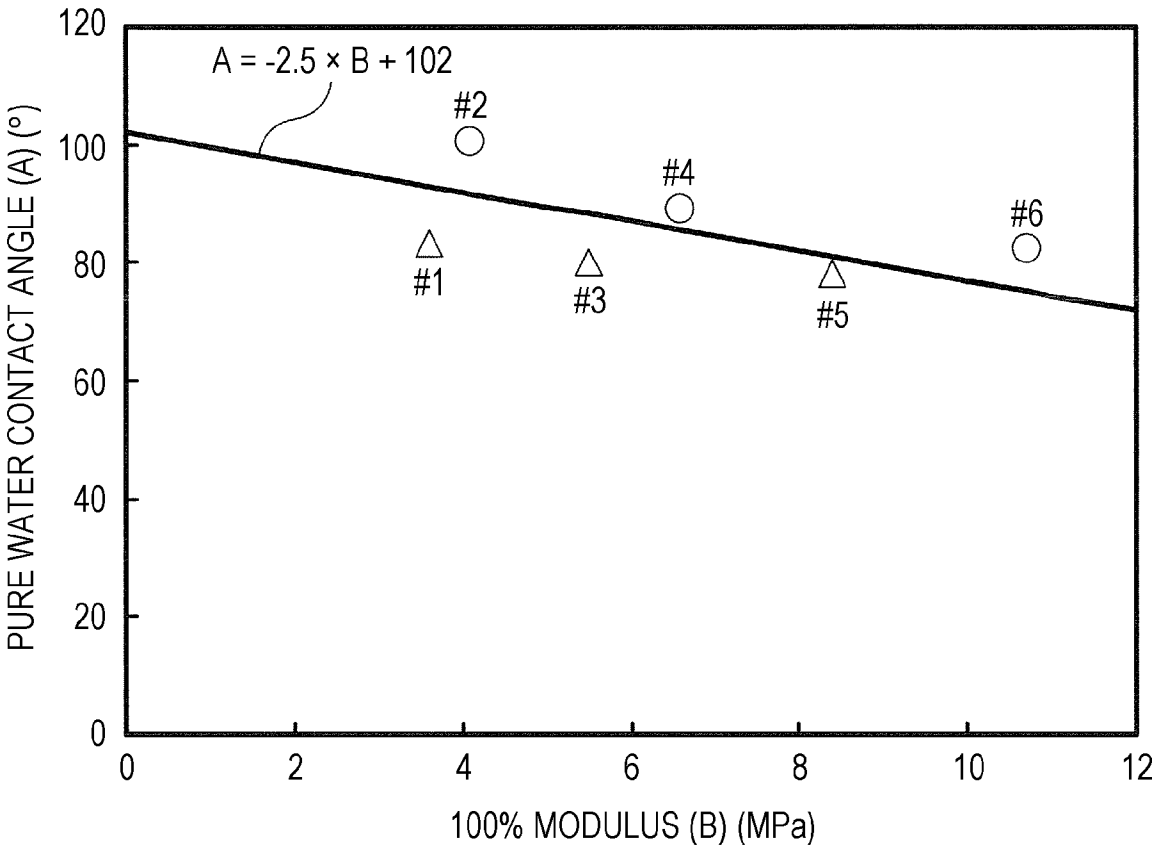
FIG. 5 illustrates the relationship between the pure water contact angle (A) (°) and 100% modulus (B) (MPa) of the cleaning blade.

FIG. 5 illustrates the relationship between the pure water contact angle (A) (°) and 100% modulus (B) (MPa) of the cleaning blade 42. In FIG. 5, the relationship when the equal sign in expression (1) holds is illustrated. The cleaning blades 42 denoted by #2, #4, and #6 satisfy expression (1). However, the cleaning blades 42 denoted by #1, #3, and #5 do not satisfy expression (1).

From FIGS. 4 and 5, for each of the cleaning blades 42 denoted by #2, #4, and #6 whose contact layer 42*a* satisfies expression (1), rolling-up does not occur in the cleaning blade 42 when used in combination with the silica particles denoted by @2 to @4. In contrast, for each of the cleaning blades 42 denoted by #1, #3, and #5 that do not satisfy expression (1), rolling-up of the cleaning blade 42 occurs irrespective of which one of the silica particles @1 to @5 the cleaning blade 42 is used in combination with.

From the above discussion, occurrence of rolling-up of the cleaning blade 42 is reduced when the following conditions are met: the contact layer 42*a* of the cleaning blade 42 satisfies expression (1); the pure water contact angle (A) of the contact layer 42*a* of the cleaning blade 42 is not less than 82° and not more than 101°; and toner containing an irregular-shaped external additive with a 100% modulus (B) of not less than 4 MPa and not more than 11 MPa and a circularity of not less than 0.5 and not more than 0.9 is used.

[Cleaning Test]

FIG. 6 illustrates the results of a test (cleaning test) conducted to check the cleaning performance of the cleaning blade 42. In FIG. 6, as in FIG. 4, six kinds of cleaning blades (#1 to #6) are arranged vertically, and five kinds of silica particles (@1 to @5) as external additives contained in the corresponding toners are arranged horizontally.

The cleaning test is carried out under the environment of 10° C. and 20% RH. The paper P used has an A4 size with a basis weight of 200 g/m$^2$. The dot percent (Cin) of image-forming toner images is 8% for each of the colors Y, M, C, and K. The contact pressure of the cleaning blade 42 with the second transfer roller 22 is 29.4 kPa. Under these conditions, image-forming toner images are formed on 200,000 sheets of paper P, and a sheet of A3-size paper P is inserted at predetermined intervals, and the stains on a portion of the back surface of the A3-size paper P which lies outside the A4 region are checked.

In the evaluation, cases where no stains have occurred on the back surface are evaluated as "○", cases where slight stains have occurred are evaluated as "Δ", and cases where stains have occurred are evaluated as "x". Further, cases evaluated as "○" are defined as "Examples", and cases evaluated as "Δ" and "x" are defined as "Comparative Examples". Combinations of the respective numbers of the identification symbols (#1 to #6) of the cleaning blade 42 and of the identification symbols (@1 to @5) of the silica particles are added to "Examples" and "Comparative Examples" to differentiate between these examples. The results on Examples and Comparative Examples become the same as the results of the rolling-up test illustrated in FIG. 4.

First, in cases where the relationship between the pure water contact angle (A) and 100% modulus (B) of the contact layer 42*a* of the cleaning blade 42 does not satisfy expression (1) (#1, #3, and #5), the cleaning performance is evaluated as "x".

Further, in cases where the relationship between the pure water contact angle (A) and 100% modulus (B) of the contact layer 42*a* of the cleaning blade 42 satisfies expression (1) (#2, #4, and #6), no stains have occurred on the back surface under the testing conditions when the corresponding cleaning blades 42 are used in combination with the silica particles denoted by @2 to @4. However, stains occur on the back surface when the corresponding cleaning blades 42 are used in combination with the silica particles denoted by @1 which have the smallest circularity, and the silica particles denoted by @5 which have the largest circularity.

From the above discussion, it is appreciated that when the contact layer 42*a* of the cleaning blade 42 satisfies expression (1), and toner containing an irregular-shaped external additive having a circularity of 0.5 to 0.9 is used, occurrence of stains on the back surface of the paper P is reduced.

Further, when the contact layer 42*a* of the cleaning blade 42 satisfies expression (1), and toner containing an irregular-shaped external additive having a circularity of 0.5 to 0.9 is used, occurrence of rolling-up of the cleaning blade 42 as well as occurrence of stains on the back surface of the paper P are reduced.

Second Exemplary Embodiment

The image forming apparatus 1 according to the first exemplary embodiment is an image forming apparatus employing a tandem-type intermediate transfer system, and includes the second transfer section 20 using the second transfer roller 22. The image forming apparatus 1 according to a second exemplary embodiment is an image forming apparatus employing a tandem-type direct transfer system.

Figure 7:
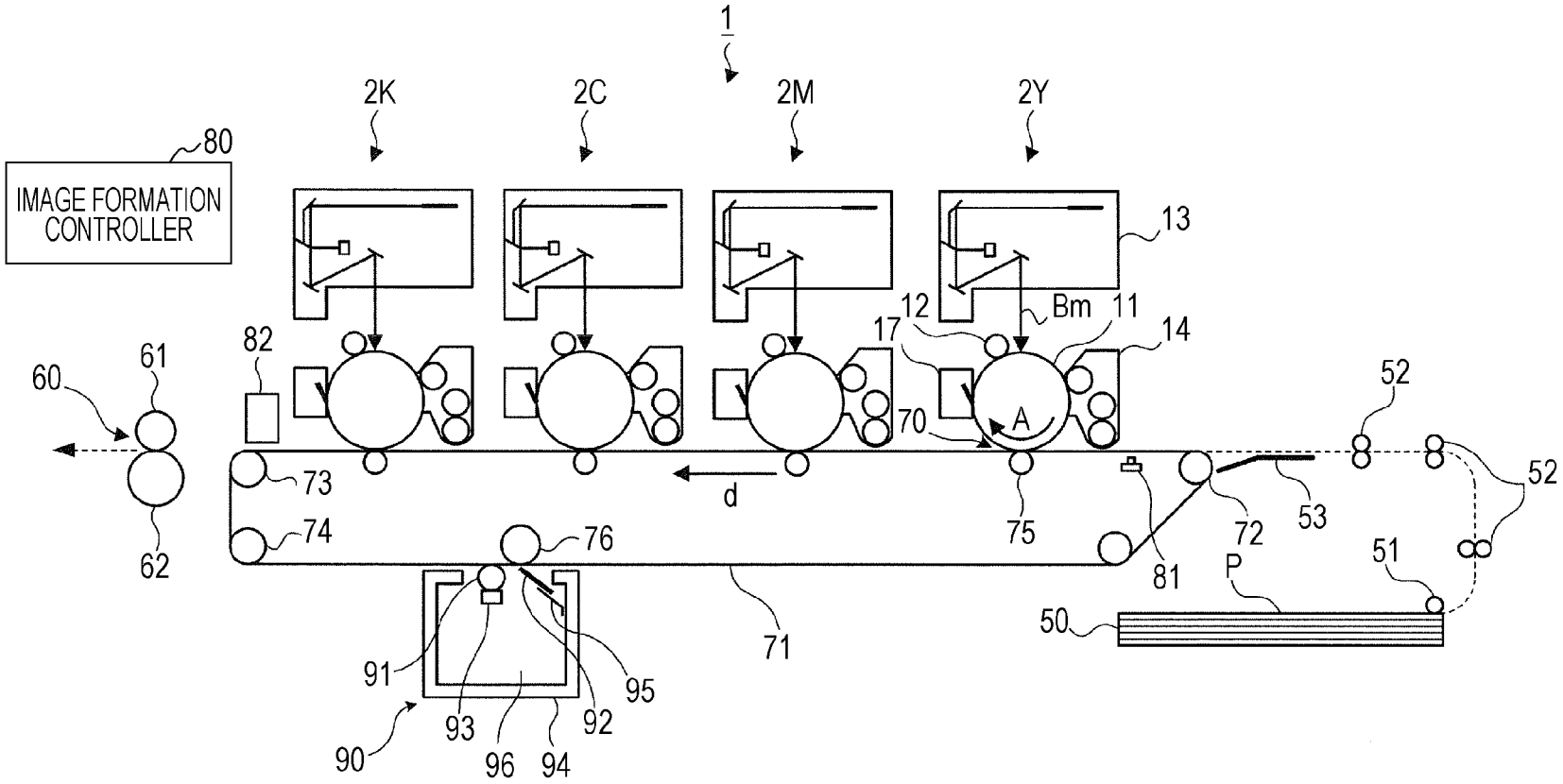
FIG. 7 is a schematic diagram illustrating an example of an image forming apparatus according to a second exemplary embodiment.

FIG. 7 is a schematic diagram illustrating an example of the image forming apparatus 1 according to the second exemplary embodiment. Portions that are the same as those of the first exemplary embodiment are denoted by the same symbols and their description is omitted, and portions different from those of the first exemplary embodiment will be described.

Like the image forming apparatus 1 according to the first exemplary embodiment illustrated in FIG. 1, the image forming apparatus 1 according to the second exemplary embodiment includes the image forming units 2Y, 2M, 2C, and 2K, the fixing section 60, and the image formation controller 80.

Each of the image forming units 2Y, 2M, 2C, and 2K of the image forming apparatus 1 according to the second exemplary embodiment includes a transfer section 70. The transfer section 70 sequentially transfers toner images of various colors (color components) formed on the respective photoconductor drums 11 of the image forming units 2Y, 2M, 2C, and 2K, to the paper P transported by a transfer/transport belt 71. The photoconductor drums 11 are another example of carrier. The transfer/transport belt 71 is another example of transfer member.

The transfer/transport belt 71 is made of the same material as that of the intermediate transfer belt 15 according to the first exemplary embodiment. The transfer/transport belt 71 is driven to circulate (rotate) by various rollers at a predetermined speed in the direction of an arrow d illustrated in FIG. 7. The various rollers include a drive roller 72, a support roller 73, a tension roller 74, a backup roller 75, and a cleaning backup roller 76. The drive roller 72 is driven by a motor (not illustrated) with good constant velocity property and rotates the transfer/transport belt 71. The support roller 73 supports the transfer/transport belt 71 that extends substantially linearly along the arrangement direction of each photoconductor drum 11. The tension roller 74 applies a predetermined tension to the transfer/transport belt 71, and functions as a correction roller that prevents meandering of the transfer/transport belt 71. The backup roller 75 is provided in the transfer section 70. The cleaning backup roller 76 is provided opposite to a belt cleaner 90 that scrapes off toner that exists on the transfer/transport belt 71.

The transfer section 70 is configured by the backup roller 75 that is placed opposite to the photoconductor drum 11 across the transfer/transport belt 71. The backup roller 75 includes a shaft, and a sponge layer as an elastic layer that is secured around the shaft. The shaft is a cylindrical bar made of metal such as iron or SUS. The sponge layer is formed of a blended rubber of NBR, SBR, and EPDM in which a conductive agent such as carbon black is blended. The sponge layer is a sponge-like cylindrical roller with a volume resistivity of $10^{71}$ Ωcm to $10^{9}$ Ωcm. The backup roller 75 is pressed against the photoconductor drum 11 with the transfer/transport belt 71 therebetween.

Further, the backup roller 75 is applied with a positive voltage (transfer bias), which is of opposite polarity to the polarity (negative) of the charge on the toner, by a transfer power source (not illustrated). Consequently, toner images on individual photoconductor drums 11 are electrostatically attracted to the paper P on the transfer/transport belt 71 sequentially, and the toner images are transferred to the paper P.

The belt cleaner 90 that removes toner adhering to the transfer/transport belt 71 is provided. Like the image forming apparatus 1 according to the first exemplary embodiment, the belt cleaner 90 includes a cleaning brush 91 and a cleaning blade 92. The cleaning brush 91 is placed on the downstream side of the transfer section 70 so as to be rotatably in contact with the transfer/transport belt 71. The cleaning blade 92 is another example of removing member that is provided further downstream of the cleaning brush 91 in the movement direction of the transfer/transport belt 71. The belt cleaner 90 also includes a lubricant block 93, a cleaner housing 94, and a support member 95. The lubricant block 93 holds the lubricant supplied to the cleaning brush 91. The cleaner housing 94 accommodates the cleaning brush 91, the cleaning blade 92, and the lubricant block 93. The support member 95 secures the cleaning blade 92 to the cleaner housing 94 to thereby support the cleaning blade 92 in place. Further, the belt cleaner 90 has a storage section 96 inside the cleaner housing 94. The storage section 96 stores waste toner.

Since various components of the belt cleaner 90 are the same as various components of the roller cleaner 40 according to the first exemplary embodiment, their description is omitted.

The basic image forming process by the image forming apparatus 1 according to the second exemplary embodiment is the same as that according to the first exemplary embodiment. In the second exemplary embodiment as well, as illustrated in FIG. 3 with reference to the first exemplary embodiment, each of the image forming units 2Y, 2M, 2C, and 2K form the image-forming toner images 101, the gap toner image 102, and the end toner images 103.

In the transfer section 70, the backup roller 75 is pressed against the photoconductor drum 11 via the transfer/transport belt 71. At this time, the paper P transported to the transfer section 70 with synchronized timing is nipped between the photoconductor drum 11 and the transfer/transport belt 71. At this time, a positive voltage (transfer bias), that is, a voltage of opposite polarity to the polarity (negative) of the charge on the toner is supplied to the backup roller 75 from the transfer power source (not illustrated). Then, a transfer bias is formed between the photoconductor drum 11 and the backup roller 75 with the transfer/transport belt 71 therebetween, and the image-forming toner images 101 carried on the photoconductor drum 11 are transferred onto the paper P.

At this time, the end toner images 103 are transferred onto the transfer/transport belt 71. Likewise, the gap toner image 102 is also transferred onto the transfer/transport belt 71. Therefore, toner forming each of the gap toner image 102 and the end toner images 103 adheres to the transfer/transport belt 71.

The paper P to which the image-forming toner images 101 formed by the image forming units 2Y, 2M, 2C, and 2Y have been sequentially transferred is transported to the fixing section 60.

Then, toner adhering to the transfer/transport belt 71 is removed by the roller cleaner 90.

Like the cleaning blade 42 illustrated in FIG. 2A, the cleaning blade 92 has a contact layer that contacts the transfer/transport belt 71, and a non-contact layer that is stacked on top of the contact layer and does not contact the transfer/transport belt 71. Further, the contact layer is made of an elastic material whose pure water contact angle (A) and 100% modulus (B) satisfy expression (1), and the non-contact layer is made of an elastic material with a 100% modulus (B) lower than that of the contact layer. Other characteristics are the same as those described above with reference to the first exemplary embodiment.

As in the first exemplary embodiment, the toner includes a toner body, and an external additive that adheres to the surface of the toner body. As in the first exemplary embodiment, the external additive according to the second exemplary embodiment is an irregular-shaped external additive that has a volume average particle diameter of not less than 70 nm and not more than 400 nm, and an average circularity of not less than 0.5 and not more than 0.9.

In the second exemplary embodiment, the transfer bias causes both the gap toner image 102 and the end toner images 103 to adhere onto the transfer/transport belt 71. Therefore, toner forming each of these toner images may be used as an abrasive that abrades the surface of the transfer/transport belt 71.

Therefore, according to the second exemplary embodiment as well, rolling-up of the cleaning blade 42 is reduced, thereby reducing occurrence of a cleaning failure in which the back surface of the paper P is stained.

While the above exemplary embodiments are directed to the case where toner has a negative polarity, in the case of using toner with a positive polarity, the respective polarities of the transfer bias and non-transfer bias may be reversed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a carrier configured to carry a toner image formed by a toner, the toner including a toner body and an external additive, a circularity of the external additive being about 0.5 to about 0.9;

a transfer member configured to hold a recording medium between the transfer member and the carrier, the transfer member being configured to transfer the toner image to the recording medium; and a removing member that includes a contact portion, the contact portion being configured to contact the transfer member, the removing member being configured to remove toner that adheres to the transfer member from the toner image carried by the carrier, the contact portion being made of an elastic material that satisfies expression (1) below:

$$A \geq -2.5 \times B + 102 \quad (1)$$

where A denotes a pure water contact angle (°) at 23° C. and 55% RH, and B denotes a 100% modulus (MPa) at 23° C., wherein the transfer member further comprises a release layer which has a surface roughness Rz of not more than 2 μm (Rz≤2 μm), wherein the toner image carried by the carrier includes a first toner image that is transferred to the recording medium, and a second toner image that is not transferred to the recording medium, wherein the image forming apparatus further comprises:

a transfer power source; and a transfer section comprising:

the transfer member; and a backup roller, wherein the carrier extends between the transfer member and the backup roller;

wherein the transfer power source is configured to, when the first toner image passes through the transfer section, supply a transfer bias that is a negative voltage to the backup roller, and wherein the transfer power source is configured to, when the second toner image passes through a second transfer section, supply a non-transfer bias that is a positive voltage to the backup roller.

2. The image forming apparatus according to claim 1, wherein a pure water contact angle (°) of the contact portion at 23° C. and 55% RH is about 82° to 101°, and a 100% modulus of the contact portion at 23° C. is about 4 MPa to about 11 MPa.

3. The image forming apparatus according to claim 1, wherein the toner body and the external additive of the toner have the same charge polarity.

4. The image forming apparatus according to claim 1, wherein the transfer member has a surface that is coated with fluororesin, and the contact portion of the removing member is configured to contact the surface.

5. The image forming apparatus according to claim 1, wherein the external additive is one from among: silica, cerium dioxide and strontium titanate.

6. The image forming apparatus according to claim 1, wherein the external additive is silica.

7. The image forming apparatus according to claim 1, wherein the external additive has a volume average particle diameter of not less than 70 nm and not more than 400 nm.

8. The image forming apparatus according to claim 1, wherein the removing member is a cleaning blade.

9. The image forming apparatus according to claim 1, wherein the removing member includes a non-contact portion that is configured not to contact the transfer member, the non-contact portion comprising an elastic material that has a 100% modulus (B) at 23° C. of 3 to 6 MPa.

10. A removing member of an image forming apparatus comprising a carrier configured to carry a toner image formed by a toner, the toner including a toner body and an external additive, a circularity of the external additive being about 0.5 to about 0.9, the removing member comprising:

a contact portion configured to contact a transfer member, wherein the removing member is configured to remove toner that adheres to the transfer member from the toner image carried by the carrier, and the contact portion is made of an elastic material that satisfies expression (1) below:

$$A \geq -2.5 \times B + 102 \quad (1)$$

where A denotes a pure water contact angle (°) at 23° C. and 55% RH, and B denotes a 100% modulus (MPa) at 23° C., wherein the transfer member further comprises a release layer which has a surface roughness Rz of not more than 2 μm (Rz≤2 μm), wherein the toner image carried by the carrier includes a first toner image that is transferred to a recording medium, and a second toner image that is not transferred to the recording medium, wherein the image forming apparatus further comprises:

a transfer power source; and a transfer section comprising:

the transfer member; and a backup roller, wherein the carrier extends between the transfer member and the backup roller;

wherein the transfer power source is configured to, when the first toner image passes through the transfer section, supply a transfer bias that is a negative voltage to the backup roller, and wherein the transfer power source is configured to, when the second toner image passes through a second transfer section, supply a non-transfer bias that is a positive voltage to the backup roller.

11. The removing member according to claim 10, wherein a pure water contact angle (°) of the contact portion at 23° C. and 55% RH is about 82° to 101°, and a 100% modulus of the contact portion at 23° C. is about 4 MPa to about 11 MPa.

12. An image forming apparatus comprising:

a transfer member configured to hold a recording medium between the transfer member and a carrier, the transfer member being configured to transfer a toner image to the recording medium; and a removing member comprising a contact portion, the contact portion being configured to contact the transfer member, the removing member being configured to remove toner that adheres to the transfer member from the toner image carried by the carrier, the contact portion comprising an elastic material that satisfies expression:

$$A \geq -2.5 \times B + 102,$$

where A denotes a pure water contact angle (°) at 23° C. and 55% RH, and B denotes a 100% modulus (MPa) at 23° C., wherein the transfer member further comprises a release layer which has a surface roughness Rz of not more than 2 μm (Rz≤2 μm), wherein the toner image carried by the carrier includes a first toner image that is transferred to the recording medium, and a second toner image that is not transferred to the recording medium, wherein the image forming apparatus further comprises:

a transfer power source; and a transfer section comprising:

the transfer member; and a backup roller, wherein the carrier extends between the transfer member and the backup roller;

wherein the transfer power source is configured to, when the first toner image passes through the transfer section, supply a transfer bias that is a negative voltage to the backup roller, and wherein the transfer power source is configured to, when the second toner image passes through a second transfer section, supply a non-transfer bias that is a positive voltage to the backup roller.

* * * * *